US007484725B2

(12) United States Patent
Ueda et al.

(10) Patent No.: US 7,484,725 B2
(45) Date of Patent: Feb. 3, 2009

(54) IMAGE RECORDING APPARATUS

(75) Inventors: Kiyoshi Ueda, Anjo (JP); Ryohei Suzuki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 385 days.

(21) Appl. No.: 11/276,266

(22) Filed: Feb. 21, 2006

(65) Prior Publication Data

US 2006/0236331 A1 Oct. 19, 2006

(30) Foreign Application Priority Data

Feb. 21, 2005 (JP) ..... 2005-044456

(51) Int. Cl.
*B65H 3/52* (2006.01)

(52) U.S. Cl. ..... 271/121; 271/122

(58) Field of Classification Search ..... 271/121, 271/122, 124, 167

See application file for complete search history.

(56) References Cited

U.S. PATENT DOCUMENTS

| | | | | |
|---|---|---|---|---|
| 4,381,860 | A * | 5/1983 | Silverberg | 271/120 |
| 4,544,147 | A * | 10/1985 | Dinnissen | 271/35 |
| 5,255,905 | A * | 10/1993 | Reid et al. | 271/94 |
| 5,350,168 | A * | 9/1994 | Sheridan | 271/122 |
| 2002/0117800 | A1* | 8/2002 | Kawarama et al. | 271/121 |
| 2003/0085507 | A1* | 5/2003 | Chiang | 271/121 |
| 2004/0065993 | A1* | 4/2004 | Kamijoh | 271/121 |

FOREIGN PATENT DOCUMENTS

| | | | |
|---|---|---|---|
| JP | 04112148 | A * | 4/1992 |
| JP | 199810167486 | A | 6/1998 |
| JP | 199911059942 | A | 3/1999 |
| JP | 2002249248 | A | 9/2002 |

* cited by examiner

*Primary Examiner*—Kaitlin S Joerger
(74) *Attorney, Agent, or Firm*—Baker Botts L.L.P.

(57) ABSTRACT

There is disclosed an image recording apparatus including: a housing; a medium supply cassette open upward which accommodates a stack of recording media each in the form of a sheet, and is inserted into and removed from the housing substantially horizontally in a cassette movement direction, the cassette including: a substantially horizontal bottom plate; and a slant separator plate extending obliquely upward from an edge of the bottom plate; a medium pickup device including a medium pickup roller which gives a feeding force in a first direction to a topmost one of the stack, and cooperates with the separator plate to separate the topmost recording medium from the rest of the recording media to feed in the separated recording medium; a U-shaped guide changing a feeding direction of the recording medium as fed in by the pickup device, from the first direction to a second direction opposite to the first direction; an image recording portion recording an image on the recording medium having been passed through the guide; and a restricting member contacting at least a part of the stack which ascends upward along the separator plate by continuing to move, by inertia, in a cassette insertion direction in which the cassette is inserted, in order to restrict the continuing movement of the at least a part of the stack.

18 Claims, 16 Drawing Sheets

IMAGE RECORDING APPARATUS

INCORPORATION BY REFERENCE

The present application is based on Japanese Patent Application No. 2005-044456, filed on Feb. 21, 2005, the content of which is incorporated herein by reference.

BACKGROUND OF THE INVENTION

1. Field of the Invention

The invention relates to an image recording apparatus including a medium supply cassette, such as a printer, a copy machine, and a facsimile machine. The invention more particularly relates to an image recording apparatus having a restricting member that prevents folding or buckling of a recording medium, when the recording medium is fed from a medium supply cassette set in the image recording apparatus into a feed path, and when the recording medium is fed along the feed path.

2. Description of Related Art

In an image recording apparatus such as a printer, a copy machine, and a facsimile machine, there is conventionally employed an arrangement, where a medium supply cassette is removably inserted substantially in a horizontal direction into a housing to be set in a lower portion of the housing, and a slant separator plate is disposed on the downstream side of the medium supply cassette with respect to a direction of the insertion of the medium supply cassette, so that a topmost one of stacked recording media, e.g., cut sheets of paper, is sequentially separated from the rest of the recording media, by cooperation of a medium pickup roller and the slant separator plate, and forcibly fed into a feed path extending in a sideways U-like shape from an upper end of the slant separator plate, along which the recording medium is fed to an image recording portion in the form of an inkjet recording head that operates to record an image or a dot pattern on the recording medium. Such an arrangement is disclosed in JP-A-2002-249248 (first publication) and especially in FIG. 1 thereof, for instance.

In the arrangement of the first publication, a pair of feeder rollers consisting of a drive roller and a nip roller are disposed at an entrance end of the U-shaped feed path, that is, a position adjacent to the upper end of the slant separator plate, while a pair of register rollers are disposed on an upstream side of the image recording portion, that is, a terminal end of the U-shaped feed path. When a leading edge of the recording medium fed out by the pickup roller is first nipped between the feeder rollers, the forcibly driving the recording medium by the pickup roller is terminated. When the leading edge of the recording medium as being fed by the feeder rollers reaches the register rollers, the recording medium is adjusted in orientation so that the leading edge thereof becomes parallel to an axis of the register rollers.

Meanwhile, JP-A-10-167486 (second publication) and JP-A-11-59942 (third publication) disclose an arrangement where a presser member, e.g., plate spring, is disposed in a lower portion of a housing in order to hold down a top surface of a stack of the recording media in a medium supply cassette.

In the arrangement disclosed in the second and third publications, when the medium supply cassette is inserted into the lower portion of the housing substantially in the horizontal direction and stopped at an accommodating position of the medium supply cassette in the housing, the stack of the recording media in the medium supply cassette tends to continue to move, by inertia, in the direction in which the medium supply cassette is inserted, but the presser member holding down the stack of the recording media gives a resisting force to the inertia, thereby preventing the recording media from running over a front or leading end of the medium supply cassette. However, the arrangement is disadvantageous in that the resisting force moves the recording medium in a direction opposite to the inserting direction. When the pickup roller is operated while such an undesirable phenomenon occurs, the operation of the slant separator plate to separate each recording medium from the others is not accomplished, thereby causing problems such as that a plurality of recording media are fed at a time, and shortage in an amount of feeding of the recording medium.

On the other hand, in the arrangement of the first publication, the pickup roller in the vicinity of a bottom plate of the medium supply cassette pushes the recording medium obliquely upward from the slant separator plate so that the leading edge of the recording medium fed along the U-shaped feed path is brought into contact with the register rollers with the recording medium deflecting into a U-like shape between the pickup roller and the register rollers. By the contact with the register rollers, the recording medium is adjusted in orientation and skew thereof is eliminated. However, when the amount of the recording media stacked in the medium supply cassette is small (for instance, when merely several recording media are stacked), or when the recording medium is so pliable that the recording medium can not be smoothly fed into the U-shaped feed path from the medium supply cassette and along the slant separator plate, and an intermediate portion of the pliable recording medium buckles to come far away from the slant separator plate, the above-mentioned effect of adjusting the orientation of the recording medium or eliminating the skew of the recording medium is not ensured.

SUMMARY OF THE INVENTION

It is an object of the invention to provide an image recording apparatus capable of preventing, by a single means, a stack of recording media from running over a leading end of a medium supply cassette.

To attain the above object, the present invention provides an image recording apparatus including:

- a housing;
- a medium supply cassette open upward which accommodates a stack of recording media each in the form of a sheet, and is inserted into and removed from the housing substantially horizontally in a cassette movement direction, the medium supply cassette including:
  - a substantially horizontal bottom plate; and
  - a slant separator plate extending obliquely upward from an edge of the bottom plate;
- a medium pickup device which includes a medium pickup roller which gives a feeding force in a first direction to a topmost one of the stack of the recording media, and cooperates with the slant separator plate to separate the topmost recording medium from the rest of the recording media to feed in the separated recording medium;
- a U-shaped guide which changes a feeding direction of the recording medium as fed in by the medium pickup device, from the first direction to a second direction opposite to the first direction;
- an image recording portion which records an image on the recording medium as has been passed through the U-shaped guide; and
- a restricting member which contacts at least a part of the stack of recording media which ascends upward along the slant separator plate by continuing to move, by inertia, in a cassette insertion direction in which the medium supply cassette is inserted, in order to restrict the continuing movement of the at least a part of the stack.

According to this arrangement, the recording medium is prevented from running over an upper end of the slant separator plate, and thus stably fed in by the pickup roller.

BRIEF DESCRIPTION OF THE DRAWINGS

The above and other objects, features, advantages and technical and industrial significance of the present invention will be better understood by reading the following detailed description of preferred embodiments of the invention, when considered in connection with the accompanying drawings, in which.

DETAILED DESCRIPTION OF PREFERRED EMBODIMENTS

Hereinafter, there will be described presently preferred embodiments of the invention, by referring to the accompanying drawings.

Referring first to FIGS. 1-11, there will be described an image recording apparatus according to a first embodiment of the invention.

Figure 1:
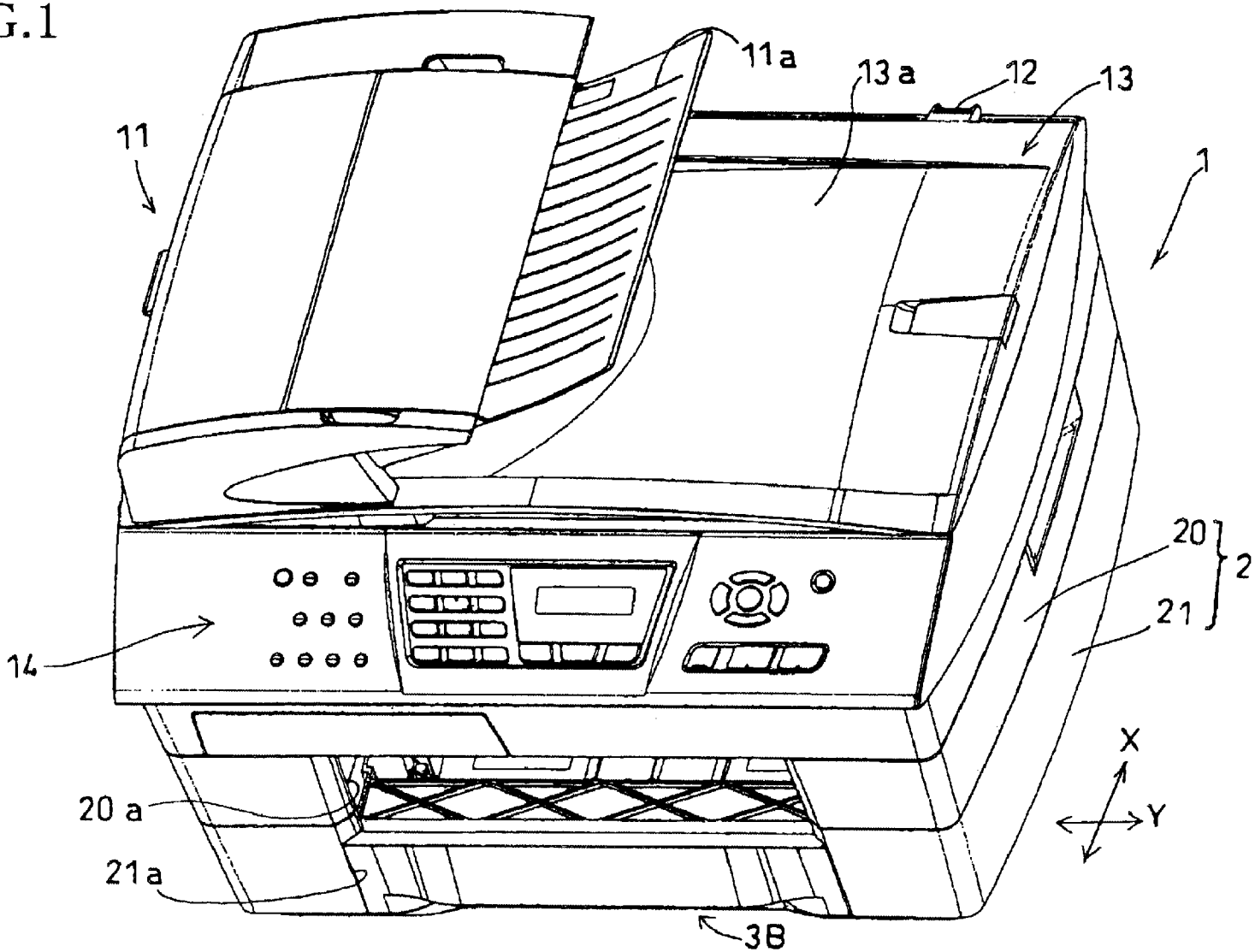
FIG. 1 is a perspective view of an image recording apparatus according to a first embodiment of the invention.

In FIG. 1, reference numeral 1 generally denotes an image recording apparatus of the first embodiment, in the form of a Multi Function Device (MFD) having a printer function, a copier function, a scanner function, and a facsimile function. The MFD 1 has a housing 2 made of synthetic resin and including a first lower casing 20 and a second lower casing 21 (or the lowermost casing 21) connected to a lower end of the first lower casing 20, and two medium supply cassettes arranged vertically, namely, an upper medium supply cassette 3A (shown in FIGS. 2 and 4) and a lower medium supply cassette 3B. The upper medium supply cassette 3A is removably inserted into the front lower casing 20 from an opening 20*a* (shown in FIG. 1) in a front side (the left-hand side in FIG. 2) of the first lower casing 20. The lower medium supply cassette 3B (shown in FIGS. 2, 5 and 7) is removably inserted into an opening 21*a* (shown in FIG. 1) in a front side (the left-hand side in FIG. 2) of the second lower casing 21. It is noted that FIG. 1 shows a state where the lower medium supply cassette 3B is accommodated in the housing 2 but the upper medium supply cassette 3A is not accommodated.

In the following description, any indication related to a front-rear direction is that as seen in FIG. 1. For instance, a side, portion, and end on the side of the openings 20*a*, 21*a* is a front side, portion, and end, while a side, portion, or end on the side opposite to the openings 20*a*, 21*a* is a rear side, portion, or end.

Figure 2:
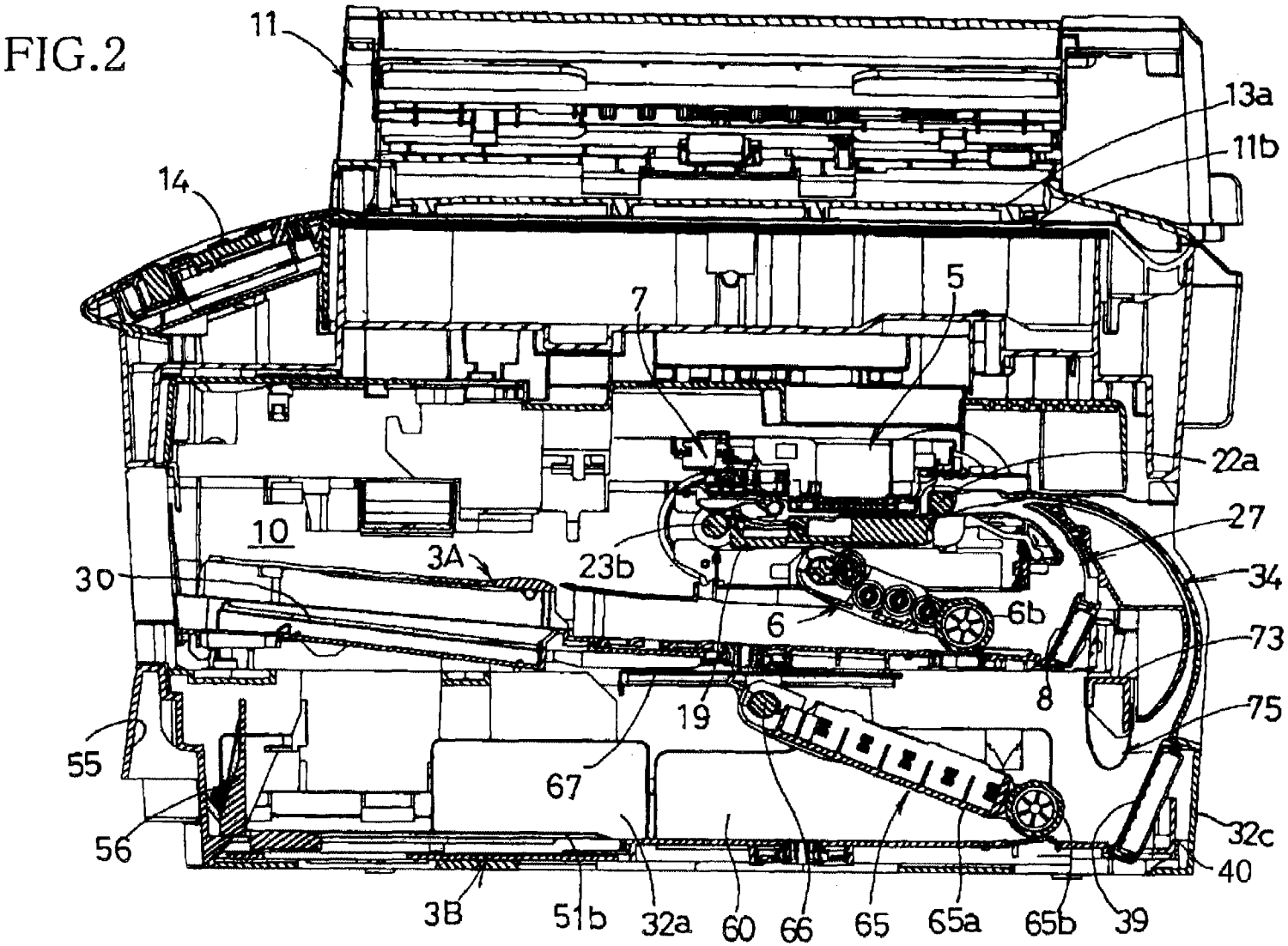
FIG. 2 is a side cross-sectional view of the image recording apparatus, showing a recording portion and an upper medium supply cassette and a lower medium supply cassette.
Figure 4:
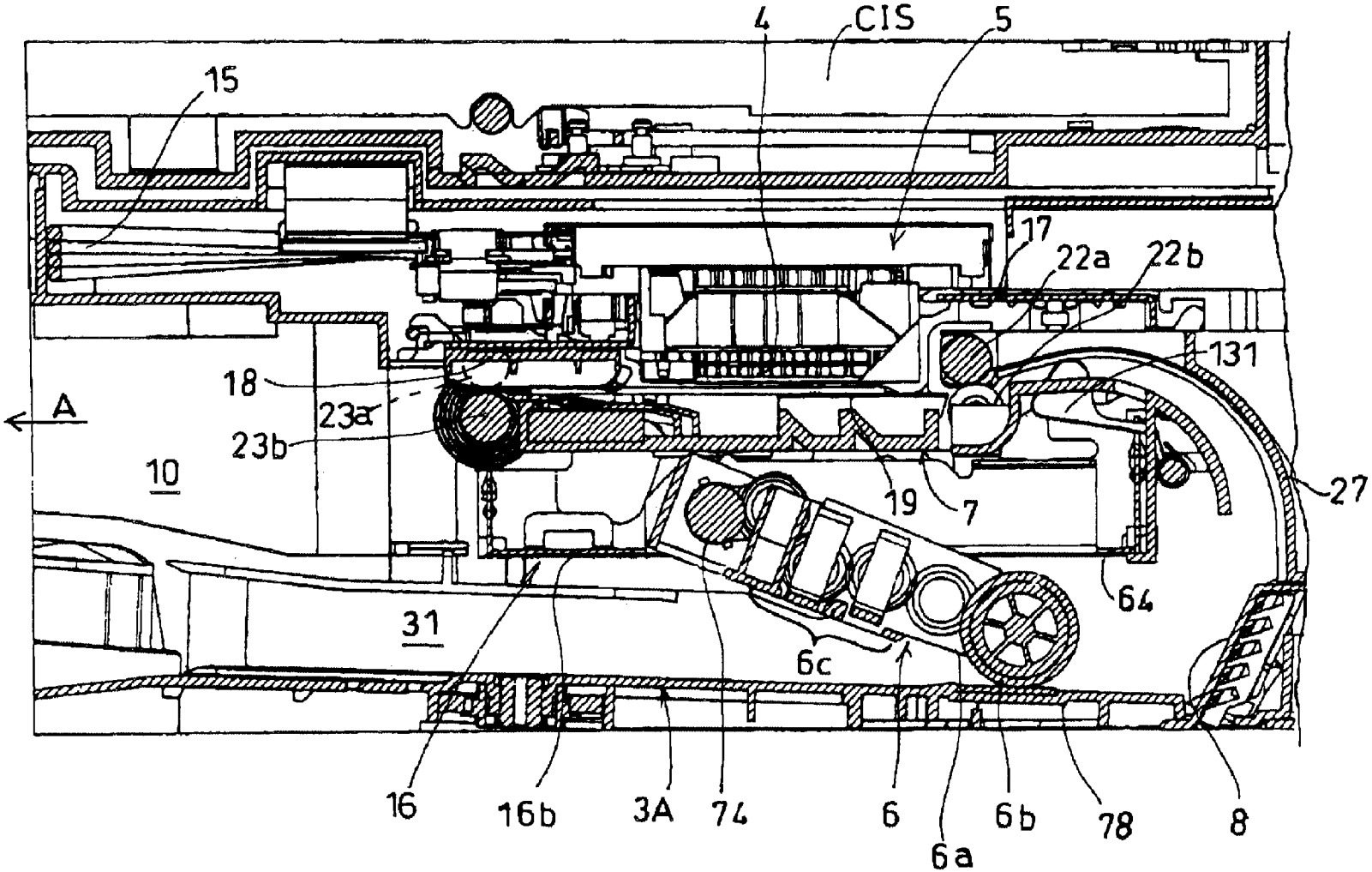
FIG. 4 is a side cross-sectional view of the recording portion and the upper medium supply cassette.

As shown in FIGS. 1 and 2, an operator panel 14 and an image reader are disposed over the housing 2. The operator panel 14 is disposed in front of the image reader, and various manual operation buttons, a liquid crystal display, and others are disposed in the operator panel 14. The image reader includes: an automatic document feeder 11 that includes a document supply tray 11*a* and is used to read a document when the copier function or the facsimile function is active, or for other purposes; a glass platen 11*b* (shown in FIG. 2) on which a document is to be placed; a document cover structure 13 which can cover an upper surface of the glass platen 11*b*, and whose upper surface constitutes a document catch tray 13*a*; and a Contact Image Sensor (CIS) that is an image sensor of close-contact type disposed under the platen glass 11*b* and supported by a support bar to be reciprocable in a direction that is perpendicular to a surface of the sheet in which FIG. 4 is presented, i.e., a main scanning direction or a Y-axis direction shown in FIG. 1. A rear end of the document cover structure 13 is attached to a rear end of the image reader such that the document cover structure 13 is vertically pivotable around a hinge 12. When an image on a document is to be read, the document cover structure 13 is opened or turned upward and the, document is placed on the glass platen 11*b*, and the CIS is then operated to read the image. Alternatively, documents in the form of discrete sheets are set on the document supply tray 11*a* of the automatic document feeder 11 and sequentially fed one by one downward to a document reading portion (not shown) corresponding to a leftmost portion (as seen in FIG. 1) of the glass platen 11*b*, where the image on the document is read. Then, the document is ejected onto the upper surface of the document cover structure 13 serving as the document catch tray 13*a*.

In the first lower casing 20, and within a project area of the operator panel 14 and the image reader in plan view, there are disposed a recording portion 7, a medium ejecting portion 10, an ink storing portion 9 (shown in FIG. 3), and others.

Figure 3:
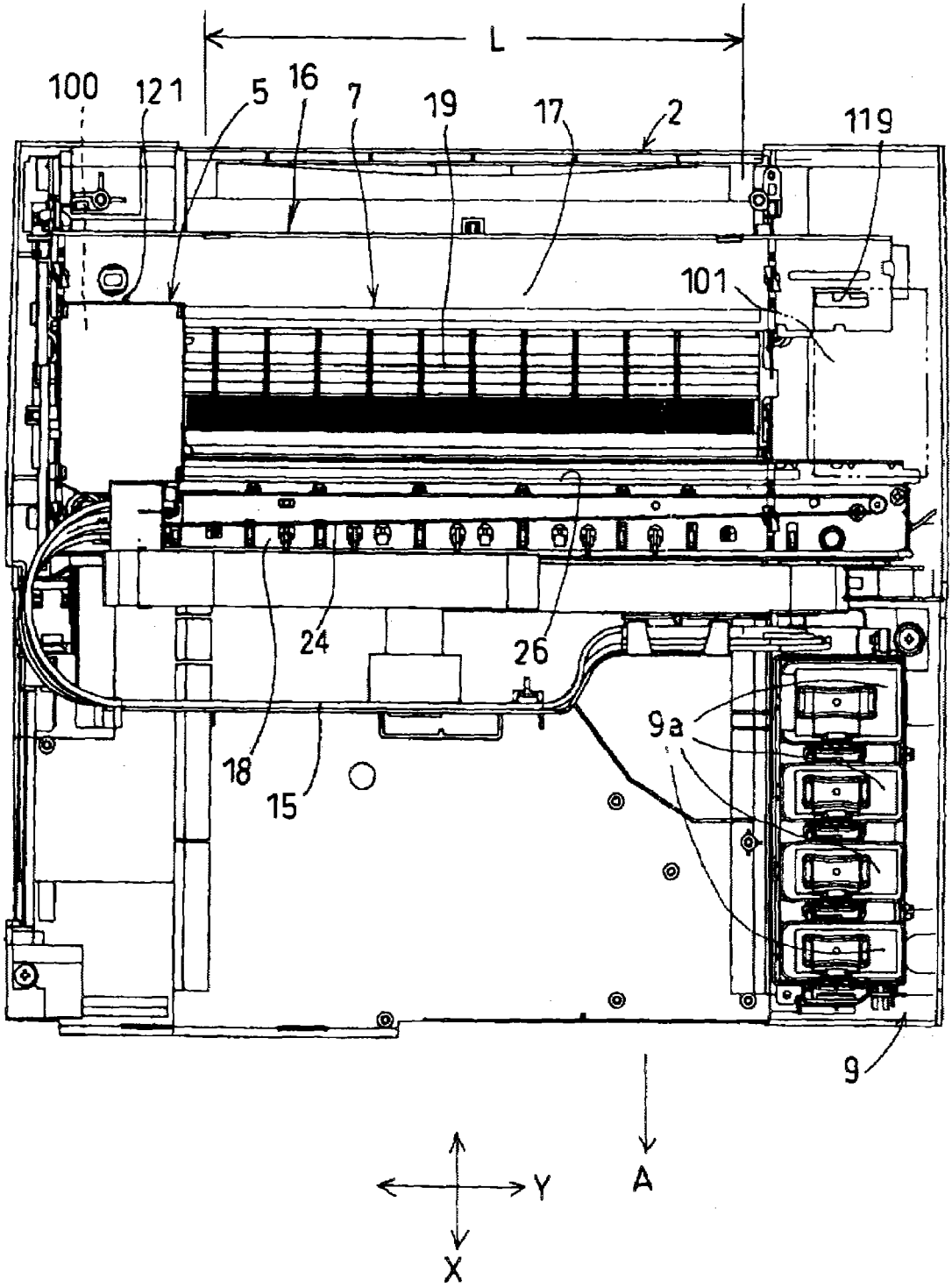
FIG. 3 is a plan view of the recording portion.

As shown in FIG. 3, the ink storing portion 9 is open toward an upper side of the housing 2, and can accommodate four ink cartridges 9*a* arranged in a row along an X-axis direction perpendicular to the Y-axis direction, such that each ink cartridge 9*a* is detachable from the ink storing portion 9 from the upper side. The ink cartridges 9*a* respectively store four inks of respective colors for full color recording, namely, black (BK), cyan (C), magenta (M), and yellow (Y). Each ink cartridge 9*a* is a container having the shape of a substantially rectangular parallelepiped with a large height and a small area in plan view.

The ink cartridges 9*a* are connected to an inkjet recording head 4 via respective flexible ink supply tubes 15, in order to supply the inks to the recording head 4.

As shown in FIGS. 2-4, the recording portion 7 is supported by a pair of lateral plates of a box-shaped main frame 16 of metal or of other materials, and extends in the Y-axis direction or the main scanning direction. The recording portion 7 includes: a first guide member 17 that is a laterally long plate-like member and disposed on an upstream side with respect to a medium feeding direction (indicated by arrow A) in which the recording medium is fed; a second guide member 18 disposed on a downstream side with respect to the medium feeding direction; a carriage 5 which is supported across and on the first and second guide members 17, 18 so that the carriage 5 is reciprocable by being slid on the guide members 17, 18, and in which the recording head 4 is mounted; a timing belt 24 that is disposed on an upper surface of the second guide member 18 to extend in parallel thereto in order to reciprocate the carriage 5; a CR (carriage) motor (not shown) for driving the timing belt 24; a plate-like platen 19 supporting a recording medium P that is fed under the recording head 4; a band-like encoder strip 26 disposed to extend in the main scanning direction in order to detect a position of the carriage 5 in the Y-axis direction or the main scanning direction; and others.

Outside an image recording area L of the recording portion 7 in a direction of a width (i.e., a shorter side) of the recording medium P, there are disposed an ink receiving portion 100 and a maintenance unit 101. The ink receiving portion 100 is located at a lateral end of the image recording area L on the left side, that is, at a position near the left-hand lateral plate of the main frame 16 shown in FIG. 3, while the maintenance unit 101 is located at the other lateral end of the image recording area L on the right side, that is, at a position near the right-hand lateral plate of the main frame 16. The maintenance unit 101 will be fully described later. During a recording operation, the recording head 4 cyclically discharges the inks at a flashing position corresponding to the ink receiving portion 100, in order to prevent clogging of nozzles. The ink receiving portion 100 receives the discharged inks. A lateral range corresponding to the maintenance unit 101 is a standby area for the carriage 5, at which are implemented operations such as an ejection-performance restoring operation such that a cap (not shown) in the maintenance unit 101 covers a nozzle surface of the recording head 4 from the under side, and the inks of respective colors are sucked selectively, that is, independently of one another, in order to remove bubbles in buffer tanks (not shown) disposed above the recording head 4. Cleaning of the nozzle surface is performed when the carriage 5 approaches the maintenance unit 101 by being laterally moved, such that a cleaner or a wiper blade (not shown) is raised to wipe the nozzle surface.

On the upstream side of the platen 19, a pair of register rollers 22*a*, 22*b* are disposed on the opposite vertical sides of the platen 19. The recording medium P nipped between the register rollers 22*a*, 22*b* is fed to the position under the recording head 4 (shown in FIG. 4). On the downstream side of th platen 19, there are disposed a gear roller 23*a* that contacts an upper surface (i.e., a recording surface) of the recording medium P, and a medium ejection roller 23*b* that contacts an under surface (i.e., a surface opposite to the recording surface) of the recording medium P. The recording medium P on which an image has been recorded is ejected onto the medium ejecting portion 10 with its recording surface facing upward. The medium ejecting portion 10 is disposed over the upper medium supply cassette 3A, and a medium outlet is formed in communication with the medium ejecting portion 10 open at the front side of the housing 2 and above the opening 20*a*, as shown in FIG. 2.

There will be now described a structure of the upper and lower medium supply cassettes 3A, 3B. Referring first to FIGS. 2 and 4, the upper medium supply cassette 3A accommodated in the first lower casing 20 will be described. The upper medium supply cassette 3A has an accommodating space (or a main cassette portion) 31 that can accommodate a stack of a plurality of recording media P, which may be cut sheets of paper in A4 size, letter size, legal size, or postcard size, for example, with the shorter sides of the recording media P extending perpendicularly to the medium feeding direction corresponding to an auxiliary scanning direction or the X-axis direction. That is, the shorter sides of the recording media P extend perpendicularly to a surface of the sheet in which FIG. 2 is presented, and parallel to the main scanning direction or the Y-axis direction. At a front end (i.e., at the side where the opening 20*a* is) of the upper medium supply cassette 3A, there is disposed an auxiliary support member 30 in order to support a rear end portion of a long recording medium P, e.g., a recording medium P of legal size, such that the auxiliary support member 30 is movable in the X-axis direction. However, when a recording medium P of a size capable of being entirely accommodated in the upper medium supply cassette 3A, e.g., recording medium of A4 size, is used, the auxiliary support member 30 is housed in the upper medium supply cassette 3A so as not to protrude from the opening 2*a* into the exterior of the first lower casing 20, as shown in FIG. 2, thereby not hampering feeding of a recording medium.

On the rear side (i.e., the downstream side with respect to the medium feeding direction) of the upper medium supply cassette 3A, there is disposed a slant separator plate 8 for separating a topmost one of the stack of the recording media from the rest of the recording media. An upper end portion of a medium pickup arm 6*a* of a first medium pickup device 6 (described later) is attached to the housing 2 such that the medium pickup arm 6*a* is movable in a vertical direction by being pivoted around an axis, and a medium pickup roller 6*b* disposed at a lower, free end of the medium pickup arm 6*a* and the slant separator plate 8 cooperate to sequentially pick up or separate and feed one by one the recording media P stacked in the upper medium supply cassette 3A. Each recording medium P as separated is fed to the recording portion 7 disposed above the upper medium supply cassette 3A via a first sideways U-turn pathway 27. The slant separator plate 8 is curved to protrude at a widthwise central portion thereof with respect to the recording medium P, i.e., at a central portion of the cassette 3A in the Y-axis direction. That is, in plan view, the slant separator plate 8 is curved rearward from the center in the width direction of the recording medium P toward the opposite lateral sides in the same direction. At a central portion of the slant separator plate 8 in the width direction, a sawtooth-like elastic separator pad (shown in FIG. 4) is disposed in order to contact a leading edge of each recording medium P, thereby promoting separation of each recording medium P.

Figure 5:
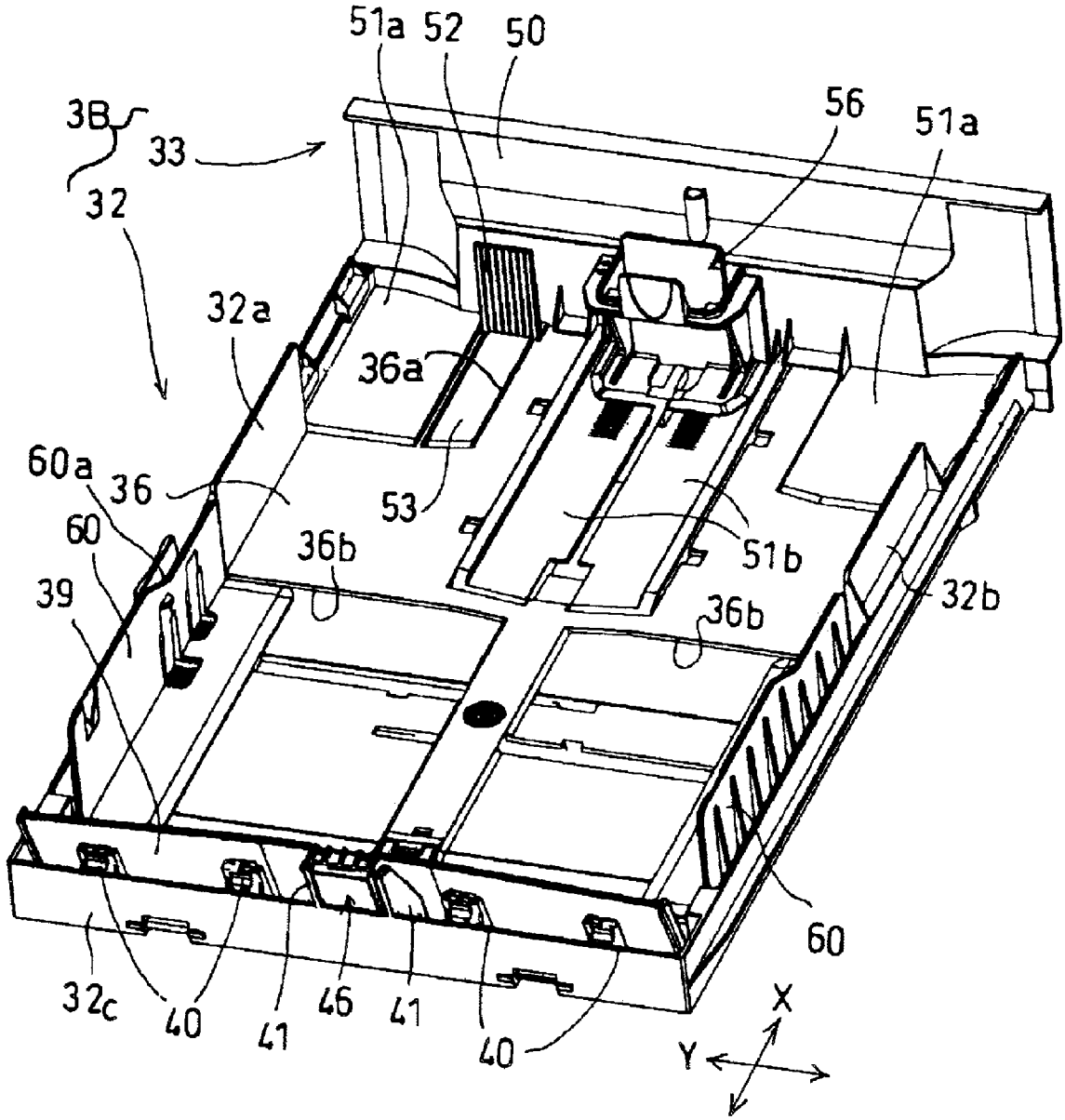
FIG. 5 is a perspective view of the lower medium supply cassette.

As shown in FIGS. 2 and 5, the lower medium supply cassette 3B includes a main body 32 open on the upper side and capable of accommodating a stack of the recording media P, and an extensible portion 33 open on the upper side and attached to the main body 32 to be movable in the front-rear direction relative to the main body 32, so that a rear end portion of the recording media P in the feeding direction (i.e., the X-axis direction) is placed on the extensible portion 33. Both of the main body 32 and the extensible portion 33 are formed of synthetic resin by injection molding. The extensible portion 33 is disposed near the opening 21*a* in the second lower casing 21. The box-shaped second lower casing 21 (shown in FIG. 6) open at the upper side is connectable to the lower end of the above-described first lower casing 20 by screwing or otherwise. A cutout portion 35 (shown in FIGS. 6 and 7) is formed across a rear face of the first lower casing 20 and a rear face of the second lower casing 21 so that a guide defining the first sideways U-turn pathway (or a first feeding path) 27 and another guide defining a second sideways U-turn pathway (or a second feeding path) 34 (shown in FIG. 2) integrally formed with the first sideways U-turn pathway are removably attachable in the cutout portion 35.

As shown in FIG. 5, the main body 32 includes a base plate 36, a right side plate 32*a* and a left side plate 32*b*, and a rear side plate 32*c*. In front of the rear side plate 32*c*, there are arranged, in the Y-axis direction and at suitable intervals, a plurality of first rear-side supporters 41 and a plurality of second rear-side supporters 40 that are trapezoidal or triangular in side view, as shown in FIGS. 2 and 5, in order to support from the rear side the slant separator plate 39 constituted by a single plate-like member. Each of the second rear-side supporters 40 near the opposite lateral ends of the recording medium P has an engaging groove extending downward from an upper end thereof Claws each in a T-like shape in cross section are integrally formed on the rear side of the slant separator plate 39, with synthetic resin and by injection molding, so that each of the claws engages with one of the engaging grooves from the upper side.

At the central portion of the slant separator plate 39 in its longitudinal direction (i.e., the Y-axis direction or the width direction of the recording medium P), there is formed a window hole to expose from the rear side the sawtooth-like elastic separator pad (not shown) that is vertically elongate and serving as medium separating means. On the rear side of the slant separator plate 39, an attachment case 46 accommodating support members including the elastic separator pad is integrally formed as shown in FIG. 5. A reinforcing rib (not shown) is formed to extend across each of opposite lateral side surfaces of the attachment case 46 and the rear surface of the slant separator plate 39, and front slant surfaces of the first rear-side supporters 41 respectively contact the reinforcing ribs. Hence, the front side of the slant separator plate 39 as assembled protrudes at the central portion in the width direction of the recording medium P, and is inclined rearward toward the lateral opposite ends in the width direction of the recording medium P. In other words, the slant separator plate 39 is convexed or curved in the direction to get away from the leading edge of the recording medium P increasingly from the widthwise central portion toward the widthwise opposite ends.

In the front portion in the base plate 36, there is disposed a stepped portion 36*a* in which are arranged in the X-axis direction at suitable intervals, a plurality of recesses (not shown) at a widthwise position off the widthwise center of the recording medium P (or the center in the Y-axis direction perpendicular to the feeding direction of the recording medium P) to a side (namely, to the left as seen in FIG. 5) by a suitable amount. The recesses serve as engaging portions for determining an engaged position of the extensible portion 33 depending on the length of the extensible portion 33 in the feeding direction of the recording medium P.

As shown in FIGS. 2 and 5, the extensible portion 33 includes: a front wall 50 capable of closing the opening 21*a* in the front face of the second lower casing 21; a pair of rear support plates 51*a* arranged in lateral relation to each other and extending horizontally from a lower portion of the front wall so that the rear end portion of the recording medium P is placed thereon; a pair of central rear support plates 51*b*; a plate-like operating portion 52 standing to face an internal surface of the front wall 50; and an elastic support plate 53 extending from a lower end of the operating portion 52 to the downstream side with respect to the feeding direction of the recording medium P. At a front end of the elastic support plate 53, there is formed an engaging claw facing downward (not shown). Further, on an external surface of the front wall 50, there is formed a grip portion 55 open downward (shown in FIG. 2). A lower end portion of the operating portion 52 and a front end portion of the elastic support plate 53 integrally protrude from the front wall 50 to be integrally continuous with a base part elastically deformable in a vertical direction. That is, in the extensible portion 33, there are integrally formed with the front wall 50 the operating portion 52 and the elastic support plate 53 in which is disposed the engaging claw that is selectively engageable with the above-mentioned recesses arranged at suitable intervals along the feeding direction of the recording medium P.

On an upper surface of the central rear support plates 51*b*, a medium rear edge guide 56 as a limiter for positioning the recording medium P by contacting the rear edge of the recording medium P is attached, such that the guide 56 is slidable to be fixed in position with a snap at one of a plurality of places along the medium feeding direction. In a rear half portion of the base plate 36, there are a pair of stepped portions 36*b* in lateral relation to each other. In the stepped portions 36*b* are disposed a pair of medium lateral guides 60 such that the lateral guides 60 are displaceable toward and away from each other, in order to guide lateral edges of the recording medium P while setting the recording medium P symmetrically with respect to the widthwise center of the main body 32.

Figure 7:
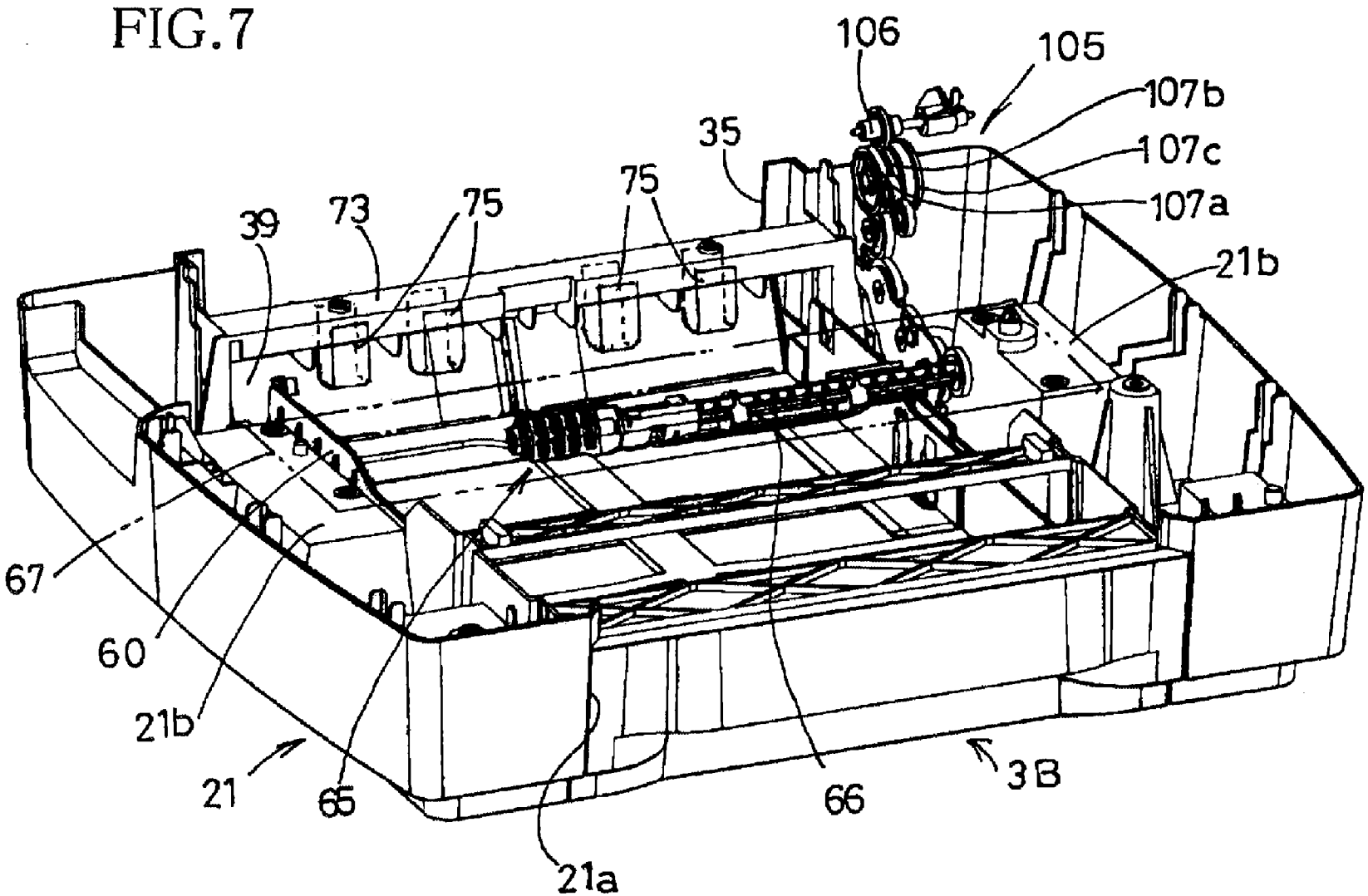
FIG. 7 is a perspective view of the lower medium supply cassette accommodated in the second lower casing, and a second medium supplier.

There will be now described, by referring to FIGS. 2, 4 and 7, the first medium pickup device 6 and a second medium pickup device 65. As mentioned above, the first medium pickup device 6 includes the medium pickup arm 6*a* that is a frame-like member made of synthetic resin, and the medium pickup roller 6*b* which is rotatably held at a free, lower end of the medium pickup arm 6*a*, and around whose outer circumferential surface a material having a high friction coefficient such as rubber is wound. At an upper end portion of the medium pickup arm 6*a*, opposite end portions of a drive shaft 74 made of synthetic resin are supported to allow rotation of the drive shaft 74. A driving force or rotation of the drive shaft 74 is transmitted to the medium pickup roller 6*b* via a gear transmission mechanism 6*c* disposed in the medium pickup arm 6*a* and including a train of gears, to rotate the medium pickup roller 6*b* in a specific direction. The gear transmission mechanism 6*c* includes: a gear integrally rotating with the drive shaft 74; a planetary gear meshing with the gear and pivotally supported by an end of a planetary arm rotatably fitted to the drive shaft 74; and a plurality (three in this specific example) of intermediate gears that transmit the driving force from the planetary gear to a gear disposed at a side of the medium pickup roller 6*b*.

Meanwhile, as shown in FIG. 2, a shaft bore is formed in each of a pair of shaft support plates that are formed by cutting a side plate and a bottom plate 16*b* of the main frame 16 at two places and raising the cut portions, and the drive shaft 74 is rotatably supported at the shaft bores. An end of the drive shaft 74 is inserted into the end portion of the medium pickup arm 6*a* of the first medium pickup device 6 so that the opposite end portions of the drive shaft 74 laterally and outward protrude from the shaft bores. The medium pickup arm 6*a* is disposed to extend downward through an opening 64 formed in the bottom plate 16*b* so that an end portion of the arm 6*a* is located below the bottom plate 16*b*. The medium pickup arm 6*a* is held biased downward by a biasing means (not shown) such as torsion spring, such that the medium pickup roller 6*b* thereof is held located below the bottom plate 16*b*.

The second medium pickup device 65 sequentially picks up the topmost one of a large stack of recording media P (e.g., about 250 recording media) accommodated in the lower medium supply cassette 3B, in order to feed the recording media P one by one, in the substantially same way as described above with respect to the first medium pickup device 6. That is, as shown in FIGS. 2 and 7, a medium pickup arm 65*a* (shown in FIG. 2) that is a frame-like member made of synthetic resin has a free, lower end at which a medium pickup roller 65*b* is rotatably supported. A material having a high friction coefficient such as rubber is wound around an outer circumferential surface of the medium pickup roller 65*b*. At an end portion of the medium pickup arm 65*a* (shown in FIG. 2), opposite end portions of a drive shaft 66 made of synthetic resin are supported such that the drive shaft 66 is rotatable. A driving force or rotation of the drive shaft 66 is transmitted to the medium pickup roller 65*b* to rotate the medium pickup roller 65*b* in a specific direction via a gear transmitting mechanism (not shown) including a train of gears disposed in the medium pickup arm 65*a*.

A plate-like support frame 67 (shown in FIGS. 2, 6 and 7) disposed below the main frame 16 is fixed to a pair of support portions 21*b* respectively formed in opposite lateral end portions of the second lower casing 21, using screws or otherwise. The support frame 67 has three shaft support plates formed by cutting the support frame 67 at three places and raising the cut portions, and each of the three shaft support plates has a shaft bore (not shown). The drive shaft 66 is inserted through, and rotatably supported by, the three shaft bores, such that the opposite end portions of the drive shaft 66 laterally and outward protrude from the end portions of the medium pickup arm 65*a* of the second medium pickup device 65. The medium pickup roller 65*b* is held biased downward by a biasing means (not shown) such as torsion spring.

When the lower medium supply cassette 3B is inserted into or pulled out (or removed) from the second lower casing 21, the medium pickup arm 65*a* is automatically pivoted upward. This is the same as with the medium pickup arm 6*a*, that is, the medium pickup arm 6*a* is pivoted upward when the upper medium supply cassette 3A is inserted into or pulled out from the first lower casing 20.

As shown in FIG. 7, a switching mechanism 105 is disposed to switch an object to which the driving force is transmitted, among the first medium pickup device 6, the second medium pickup device 65, and the maintenance unit 101. The switching mechanism 105 includes an output spur gear 106 and three input spur gears 107*a*, 107*b*, 107*c* and constructed such the spur gear 106 is selectively meshed with one of the input spur gears 107*a*-107*c*. That is, the output spur gear 106 is driven by a power source (not shown) to selectively mesh with one of the input spur gears 107*a*-107*c* depending on an amount of lateral movement of the carriage 51.

There will be now described a restricting member for preventing the inconvenience that when the lower medium supply cassette 3B is inserted in a substantially horizontal direction into a lower portion of the housing 2, the stack of the recording media P in the lower medium supply cassette 3B continues to move in the inserting direction by inertia, and upon stopping of a leading end of the lower medium supply cassette 3B at the accommodating position in the housing 2, the recording media P runs over an upper end of the slant separator plate 39 disposed at the leading end of the lower medium supply cassette 3B, leading to a plurality of the recording media P fed at a time. The restricting member also prevents the inconvenience that when an amount of the recording media P stacked in the lower medium supply cassette 3B is relatively small, such as when only several recording media P are stacked, or when the recording medium P is highly pliable, the recording medium P is not smoothly fed into the U-shaped feed path 34 along the slant separator plate 39 from the position over the base plate 36 of the lower medium supply cassette 3B, and the recording medium P buckles such that an intermediate portion thereof is separated far away from the surface of the slant separator plate 39. Thus, elimination of skew of the recording medium P is ensured.

Figure 6:
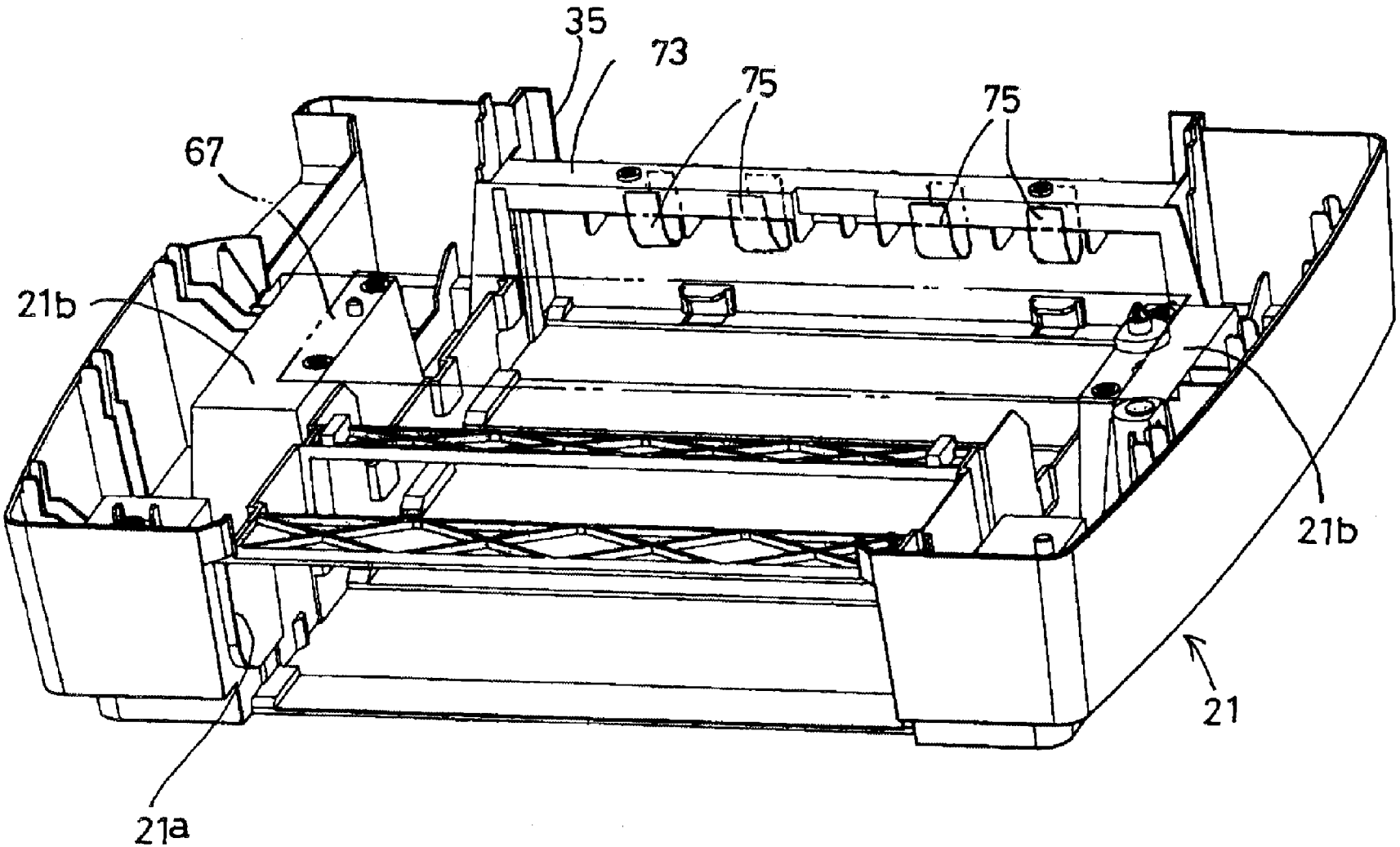
FIG. 6 is a perspective view of a second lower casing in which the lower medium supply cassette is to be accommodated.

The restricting member according to the first embodiment shown in FIGS. 2, 6 and 7 is constituted by a plurality of film members 75, each of which is formed of a strip of film material having an elasticity whose longitudinal intermediate portion is bent-so that the film member 75 extends downward in a U-hike shape. T The film members 75 are disposed in the housing 2 each in an orientation such that the film member 75 is convex downward. Each film member 75 is made of synthetic resin such as PET (polyethylene terephthalate) in a thickness of about 0.1-0.188 mm and in a width of about 15-30 mm. The film members 75 are fixed to a reinforcing beam 73 that is made of synthetic resin or other materials and disposed in a rear portion of the second lower casing 21 to laterally extend above the lower medium supply cassette 3B. More specifically, opposite end portions of each film member 75 are attached to a front vertical surface and a rear vertical surface of the reinforcing beam 73 with an adhesive 76 which may be in the form of an adhesive double coated tape (shown in FIG. 8). Although in the present embodiment the adhesive or adhesive tape 76 is pressure sensitive, other types of adhesive or adhesive tape may be employed instead. The film members 75 each extending downward from the reinforcing beam 73 are disposed in a space between the medium pickup roller 65*b* and the slant separator plate 39 of the lower medium supply cassette 3B as set in position in the second lower casing 21 of the housing 2.

The film members 75 are disposed at respective positions that are off the widthwise center of the recording medium P at which the medium pickup roller 65*b* passes, that is, each of the film members 75 is located on either of the opposite sides of the widthwise center, as shown in FIGS. 6 and 7. Hence, any film member 75 does not interfere with the medium pickup roller 65*b* when the medium pickup roller 65*b* is vertically displaced. This arrangement enables reduction in the height of the image recording apparatus. A lower end of each U-shaped film member 75 (i.e., a lowermost point in a lower end portion 75*a* of the film member 75) is located at a level not to contact a top surface of the stack of recording media P accommodated in the lower medium supply cassette 3B in a maximum amount that the lower medium supply cassette 3B can accommodate. That is, a clearance is ensured between the lower end of the U-shaped film member 75 and the top surface of the stack of recording media P in the maximum amount, once the medium supply cassette 3B has been inserted and set in position in the housing 2. In addition, the lower end is located below the upper end of the slant separator plate 39 when the lower medium supply cassette 3B is inserted into the second lower casing 21, as shown in FIG. 2.

Figure 9:
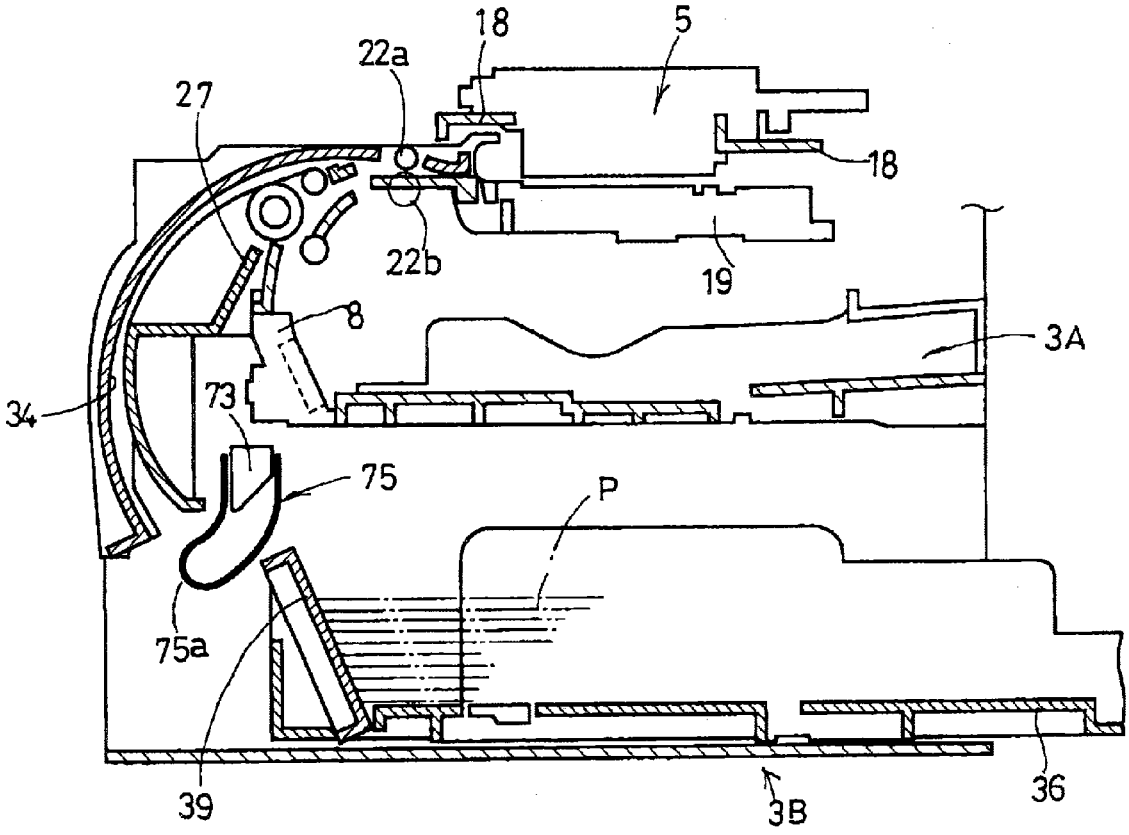
FIG. 9 illustrates a state where the lower medium supply cassette is inserted.
Figure 10:
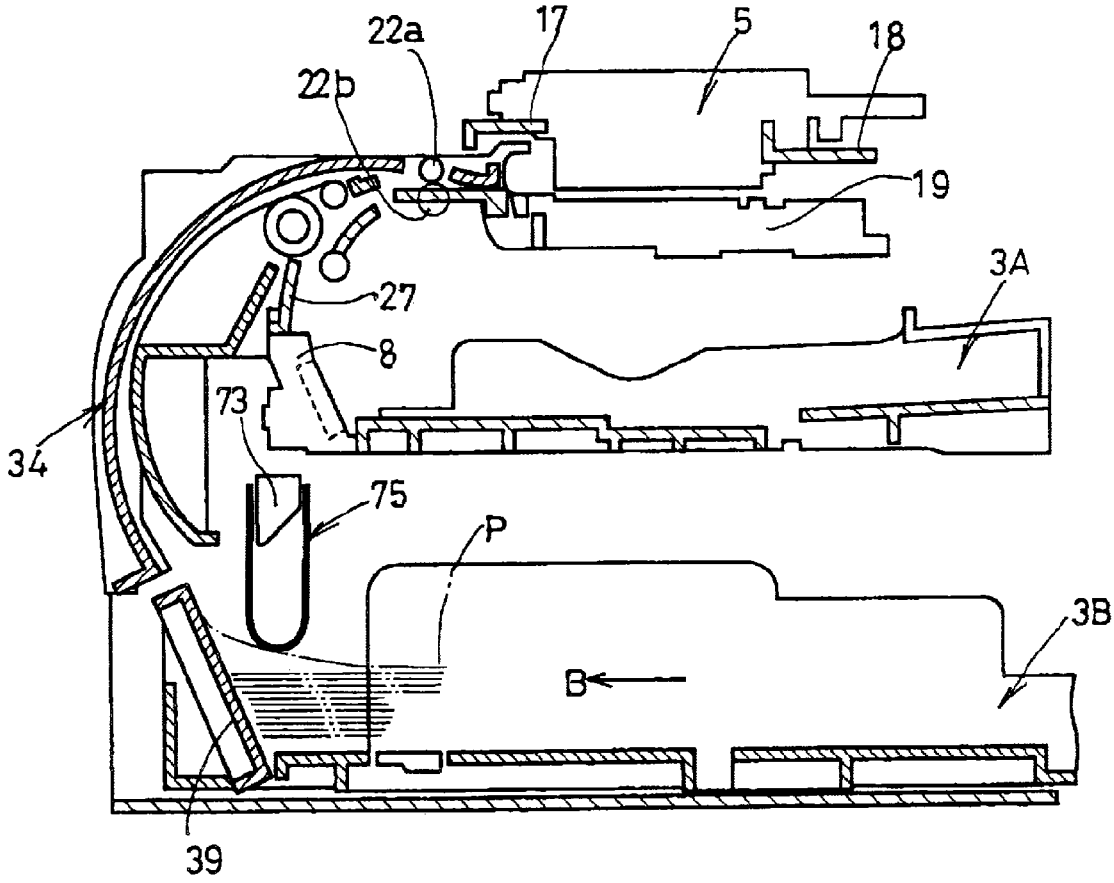
FIG. 10 illustrates a state where a stack of recording media is prevented from running over.

As shown in FIG. 9, when the lower medium supply cassette 3B is inserted deep into the second lower casing 21 and the upper end of the slant separator plate 39 meets the lower end portion 75*a* of the film member 75, each film member 75 having resiliency retracts or deflects rearward without breaking. As the insertion continues, the lower end portion 75*a* of the film member 75 slides across an upper end of the lower medium supply cassette 3B so that the film member 75 comes to be located in an upper portion of an internal space of the lower medium supply cassette 3B, as shown in FIG. 10. At this time, a leading edge of an upper portion of the stack of the recording media P moves in a direction to get across the upper end of the slant separator plate 39 due to inertia in the direction of insertion of the lower medium supply cassette 3B, namely, the direction B shown in FIG. 10. However, the lower end portion 75*a* of the film member 75 that is movable in a direction relative to the moving direction B is brought into contact with the upper portion of the stack of the recording medium P that continues to move, by inertia, in the direction B away from the rest of the recording media, thereby restricting the continuing movement of the upper portion of the stack.

Since the film member 75 extends downward from the reinforcing beam 73 such that the lower end of the film member 75 is located at the level not to contact, or spaced from, the top surface of the stack of recording media P in the maximum amount that the lower medium supply cassette 3B can accommodate when the lower medium supply cassette 3B is set in position in the second lower casing 21, the film member 75 neither gives a resistance to a separating action of the combination of the medium pickup roller 65*b* and the slant separator plate 39 to separate each recording medium P from the other recording media P, nor hampers feeding of the separated recording medium P.

Figure 11:
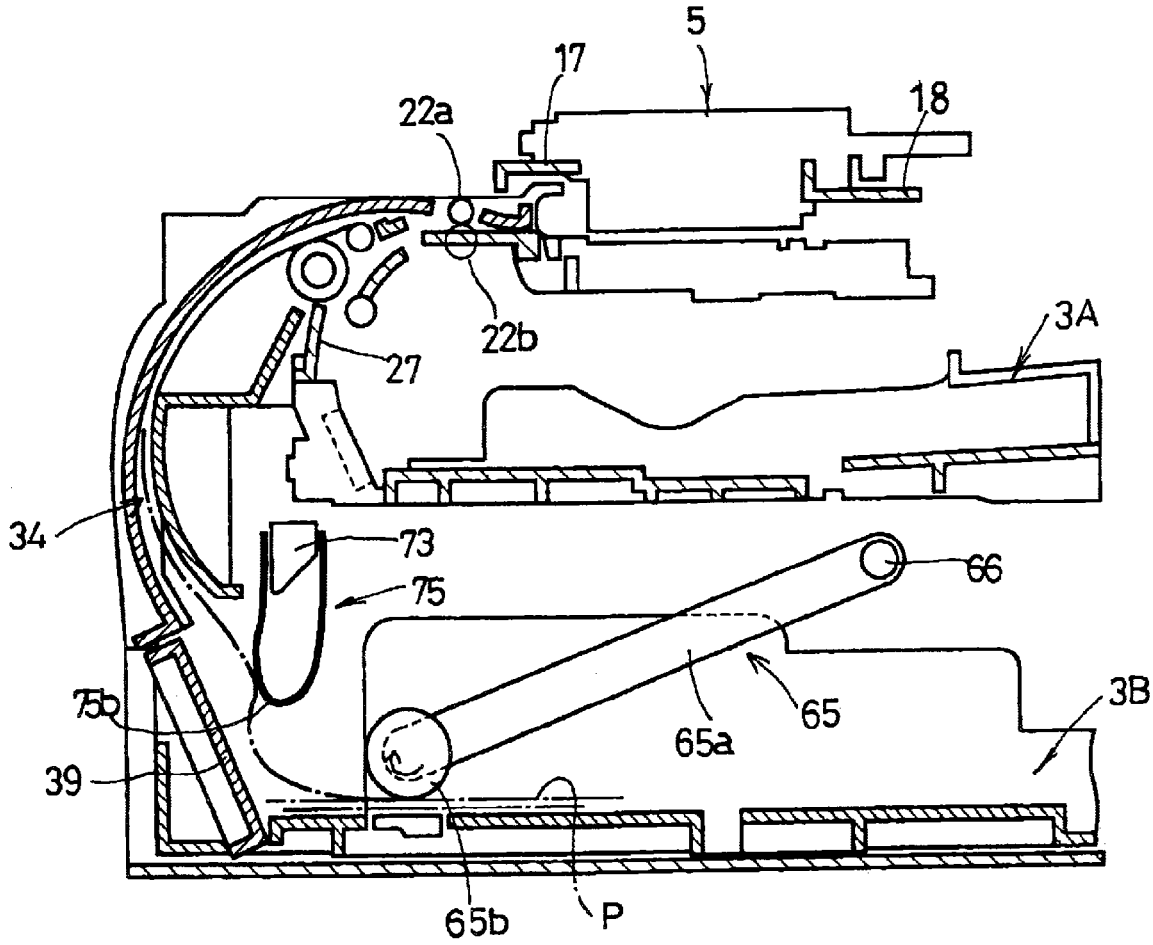
FIG. 11 illustrates a state where folding or buckling of a recording medium is prevented.

When the medium pickup roller 65*b* is driven in a state where only a small amount of recording media P is left in the lower medium supply cassette 3B and each recording medium P is highly pliable, an intermediate portion of a recording medium P as separated deflects to get far away from the surface of the slant separator plate 39 and tends to buckle while the recording medium P is pushed upward from a lower end of the slant separator plate 39. However, the deflection and buckling of the intermediate portion of the recording medium P is restricted by the film members 75 each of which has a resiliency and extends downward from the reinforcing beam 73 to narrow a clearance or a feed path defined between the surface of the slant separator plate 39 and the film members 75. That is, the recording medium P as being fed along the slant separator plate 39 may deflect or buckle, but the recording medium P deflecting or buckling contacts at least one of the resilient film members 75 or the slant separator plate 39, thereby inhibiting the recording medium P from further deflecting or buckling, or at least restricting the deflection or buckling. Thus, introduction of the recording medium P into the U-shaped feed path 34 is smoothly made, as shown in FIG. 11. The medium pickup roller 65*b* disposed near the bottom plate of the lower medium supply cassette 3B pushes the recording medium P obliquely upward from the slant separator plate 39 so that the leading edge of the recording medium P is fed to the register rollers 22*a*, 22*b* via the U-shaped feed path 34 and the recording medium P deflects into a U-like shape between the medium pickup roller 65*b* and the register rollers 22*a*, 22*b*, thereby reliably adjusting the orientation of the recording medium and eliminating skew thereof, if any.

Figure 8:
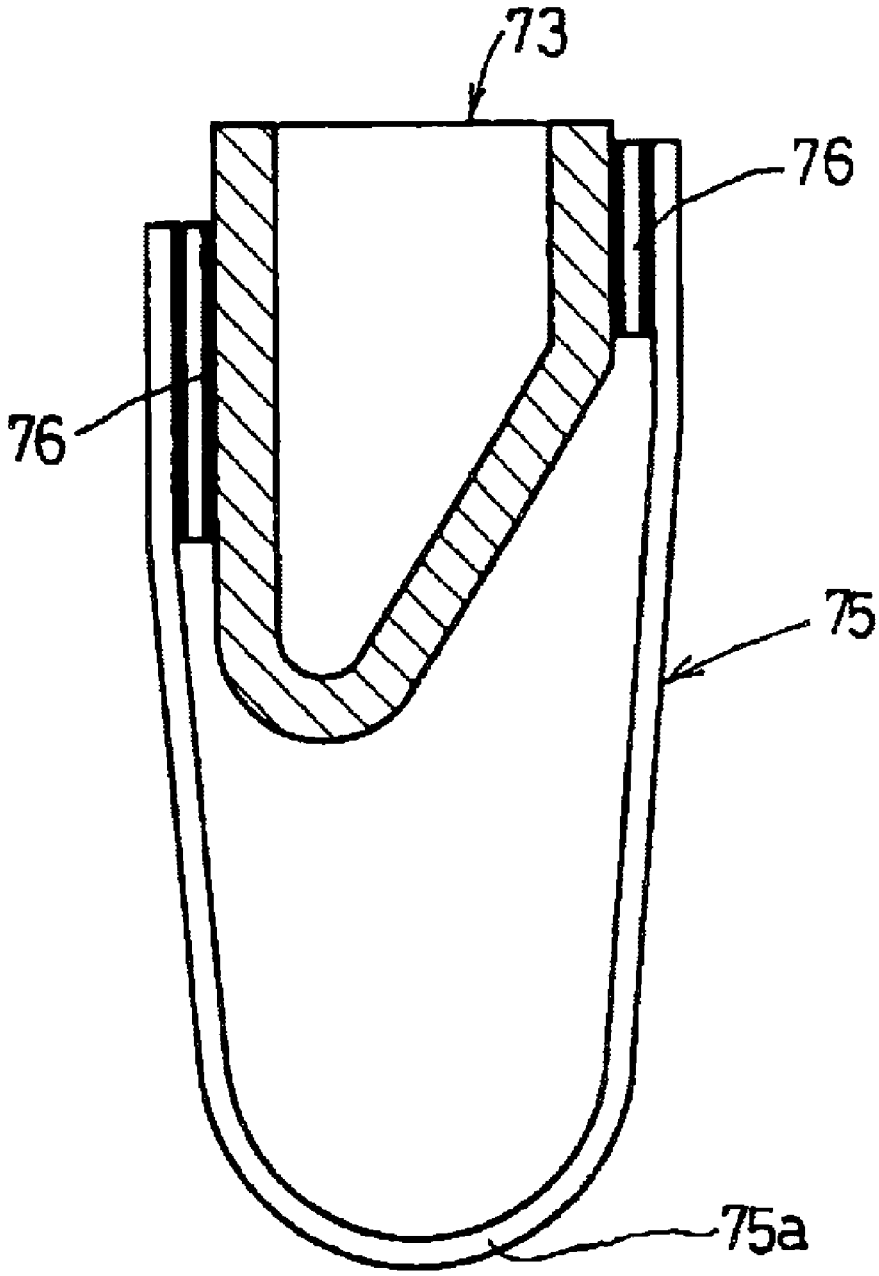
FIG. 8 is an enlarged cross-sectional view of a restricting member in the lower medium supply cassette.

As shown in FIGS. 8-11, a cross-sectional shape of the reinforcing beam 73 taken along the front-rear direction of the apparatus is asymmetric with respect to a vertical centerline of the reinforcing beam 73. Namely, a rear surface (i.e., the left-hand surface as seen in FIG. 8) of the reinforcing beam 73 extends substantially vertically and straight, but a front surface of the reinforcing beam 73 is inclined at a lower portion, such that the lower portion of the front surface extends downward and rearward from a lower end of an upper, substantially straight portion of the front surface. This configuration of the reinforcing beam is advantageous as follows. That is, the configuration makes the film member 75 more easily deformable rearward than frontward, thereby ensuring a sufficient rigidity of the film member 75 in terms of preventing the buckling of the recording medium P as being fed into the feed path. In addition, when the medium supply cassette 3B is inserted into the second lower casing 21, which insertion is made more abruptly than pulling-out of the cassette 3B sometimes, a rear upper corner of the cassette 3B bumps into the film member 75 from the front side, while when the medium supply cassette 3B is pulled out from the second lower casing 21, the slant surface of the slant separator plate 39 is brought into contact with the film member 75 relatively softly from the rear side. Thus, the configuration of the film member 75 is advantageous in absorbing an impact imposed on the film member 75 upon insertion of the medium supply cassette 3B, in order to prevent damage of the film member 75.

According to this embodiment where a thin film material is employed as a restricting member, the weight of the image recording apparatus is reduced, and it is made possible to easily make the restricting member deflectable or deformable when pushed away by the slant separator plate 39 of the medium supply cassette 3B upon insertion of the medium supply cassette 3B into the second lower casing 21.

Figure 12:
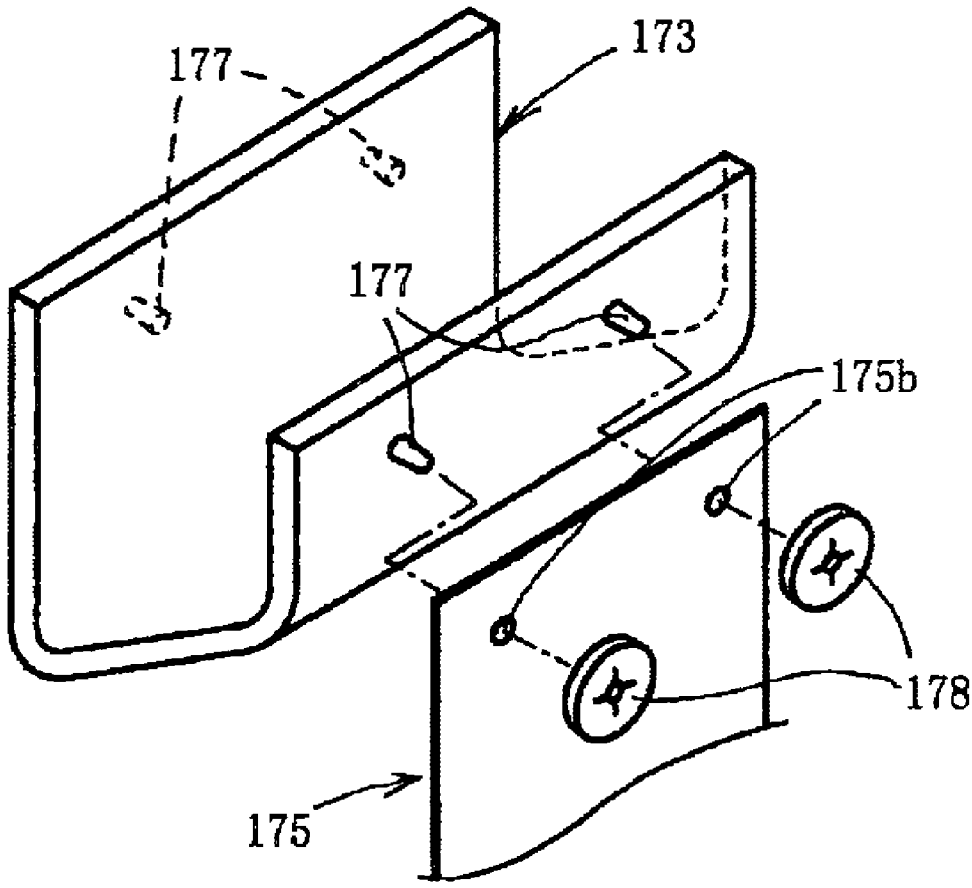
FIG. 12 is a perspective view of an arrangement for attaching a restricting member of a film material, in an image recording apparatus according to a second embodiment of the invention.

Referring now to FIG. 12, there will be described an image recording apparatus according to a second embodiment. The second embodiment is different from the first embodiment in the arrangement of fixing opposite end portions of each film member 75 to the front and rear vertical surfaces of the reinforcing beam 73. The other part of the image recording apparatus of the second embodiment is identical with that of the first embodiment and description thereof is dispensed with.

In the second embodiment, a plurality (e.g., a pair) of engaging pins 177 protrude from each of a front vertical surface and a rear vertical surface of a reinforcing beam 173. A plurality (e.g., a pair) of through-holes 175*b* are formed at each of opposite end portions of each of a plurality of film members 175. Through the through-holes 175*b*, the respective engaging pins 177 are inserted and fitted. Then, a snap nut 178 is pressed onto each engaging pin 177 to be engaged therewith. This embodiment makes easy a work operation for replacing the film member 175 with a new one.

Figure 13A:
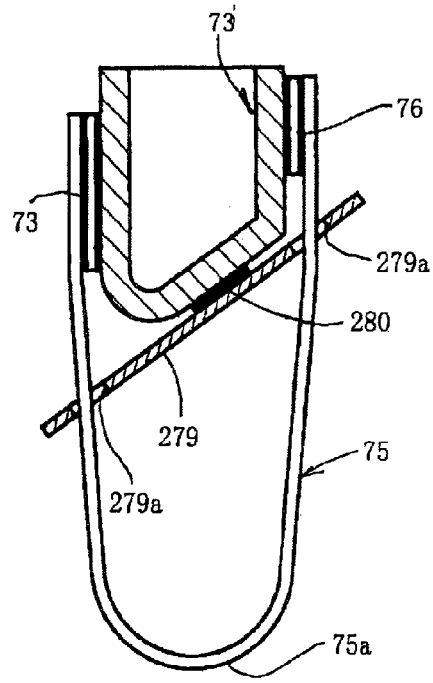
FIGS. 13A and 13B are a side cross-sectional view and an exploded perspective view of a deformation restrictor that restricts deformation of a restricting member that is formed of a film material, in order to prevent undesirable detachment of the restricting member, in an image recording apparatus according to a third embodiment of the invention.
Figure 13B:
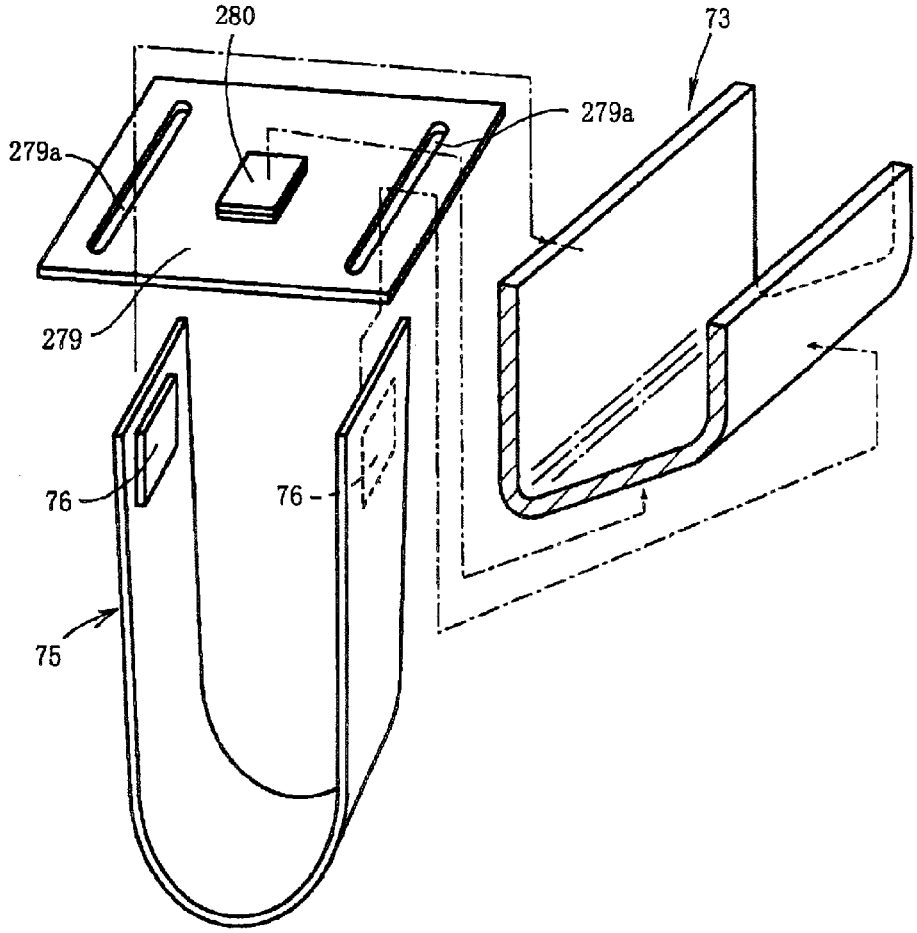

Referring now to FIGS. 13A and 13B, there will be described an image recording apparatus according to a third embodiment. The third embodiment is different from the first embodiment in the structure of each film member 275. The other part of the image recording apparatus of the third embodiment is identical with that of the first embodiment and description thereof is dispensed with.

Each time a lower medium supply cassette 3B is inserted into or pulled out from a second lower casing 21 in which a plurality of film members 75 are disposed such that opposite end portions of each film member 75 are fixed to a front vertical surface and a rear vertical surface of a reinforcing beam 73, respectively, a lower end portion 75*a* of each film member 75 contacts an upper end of a slant separator plate 39. The lower end portion 75*a* of the film member 75 is thus repeatedly deflected or deformed, causing the opposite end portions of the film member 75 fixed to the reinforcing beam 73 with an adhesive or an adhesive double coated tape 76, to unstick from the reinforcing beam 73. Hence, a deformation restrictor 279 is engaged with an intermediate portion of the film member 75, in order to restrict deformation of the film member 75. More specifically, the deformation restrictor 279 is a sheet member of synthetic resin exhibiting a rigidity of at least a level to hold an appropriate position in an operated state, namely, even when the medium supply cassette 3B is inserted and the film member 75 is deformed accordingly, and has two insertion holes 279*a*. The opposite end portions of the film member 75 are inserted through the insertion holes 279*a*. An adhesive double coated tape 280 is attached on a portion of an upper surface of the deformation restrictor 279 that is to be located between the two insertion holes 279*a* when the deformation restrictor 279 is engaged with the intermediate portion of the film member 75. The adhesive double coated tape 280 is stuck to the reinforcing beam 73 on the side opposite to the deformation restrictor 279, in order to fix the deformation restrictor 279 to the reinforcing beam 73. This arrangement reduces deformation of the intermediate portion of the film member 75 in a direction to unstick the opposite end portions of the film member 75 from the reinforcing beam 73, and gives a deformation resistance slightly larger than a deformation resistance that would be given by a film member 75 not accompanied by the deformation restrictor 279.

According to the third embodiment where the deformation restrictor 279 is disposed, the lifetime of the film member 75 is prolonged and the number of times maintenance operations are required can be reduced.

Figure 14:
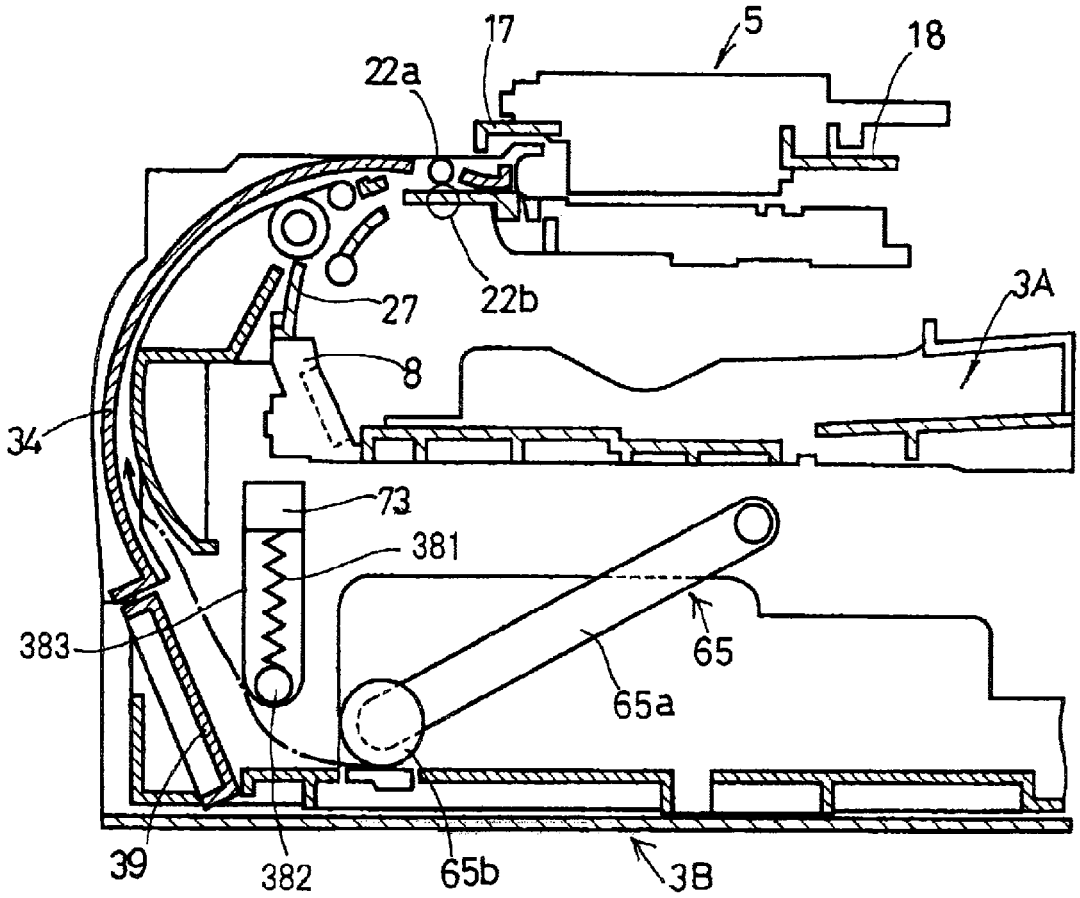
FIG. 14 is a side cross-sectional view of a restricting member in an image recording apparatus according to a fourth embodiment of the invention.

Referring now to FIG. 14, there will be described an image recording apparatus according to a fourth embodiment. The fourth embodiment is different from the first embodiment in the structure of the restricting member that is to be brought into contact with the upper portion of the stack of recording media that continues to move, by inertia, away from the rest of the recording media, upon insertion of the medium supply cassette. The other part of the image recording apparatus of the fourth embodiment is identical with that of the first embodiment and description thereof is dispensed with.

In the fourth embodiment, a film member 383, a coil spring 381, and a plummet 382 as a contact member, cooperate to constitute a restricting member. That is, in a second lower casing 21 are disposed a plurality of combinations each constituted by a film member 383, a coil spring 381, and a plummet 382. The film member 383 is formed of a strip of film material that is more pliable or softer than the film member 75 in each above-described embodiment is, and extends downward from a reinforcing beam 73 in a U-like shape. The coil spring 381 suspends from a lower surface of the reinforcing beam 73 in a space defined inside the U-shaped film member 383. The plummet 382 is attached to a lower end of the coil spring 381 such that the plummet 382 is held in contact with an inner surface of a lower end of the film member 383.

According to this arrangement, even where the elastic force of the film member 383 is insufficient, an elastic force of the coil spring 381 supplements the elastic force of the restricting member, thereby giving the same operation and effects as the first embodiment.

Figure 15:
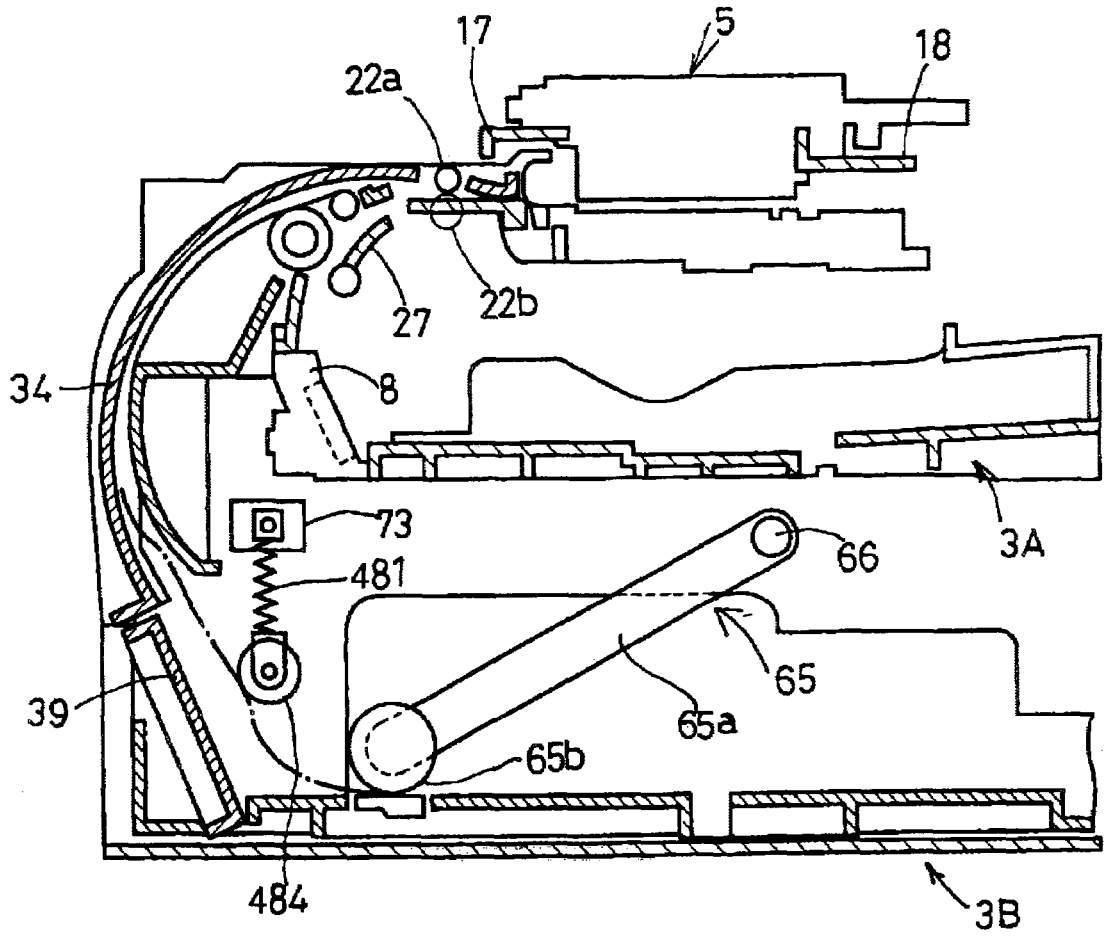
FIG. 15 is a side cross-sectional view of a restricting member in an image recording apparatus according to a fifth embodiment of the invention.

Referring now to FIG. 15, there will be described an image recording apparatus according to a fifth embodiment. The fifth embodiment is different from the first embodiment in the structure of the restricting member. The other part of the image recording apparatus of the fifth embodiment is identical with that of the first embodiment and description thereof is dispensed with.

In the fifth embodiment, a combination of a coil spring 481 and a plummet 484 (as a contact member) in the form of a roller is employed as the restricting member. That is, there are disposed a plurality of the combinations in a second lower casing 21. The coil spring 481 suspends from a lower surface of the reinforcing beam 73, and the plummet or roller 484 is attached to a lower end of the coil spring 481. When the lower medium supply cassette 3B is inserted into or pulled out from the second lower casing 21, a deflection or deformation of the restricting member due to contact between the roller 484 and an upper end of the slant separator plate 39 is permitted by an elastic displacement of the coil spring 481. Since the roller 484 suspended from the reinforcing beam 73 narrows a clearance or a feed path defined between the roller 484 and a surface of the slant separator plate 39, similarly to the first embodiment, and the coil spring 481 has a resiliency, deflection or buckling of an intermediate portion of a recording medium P as fed along the slant separator plate 39 can be restricted.

Figure 16:
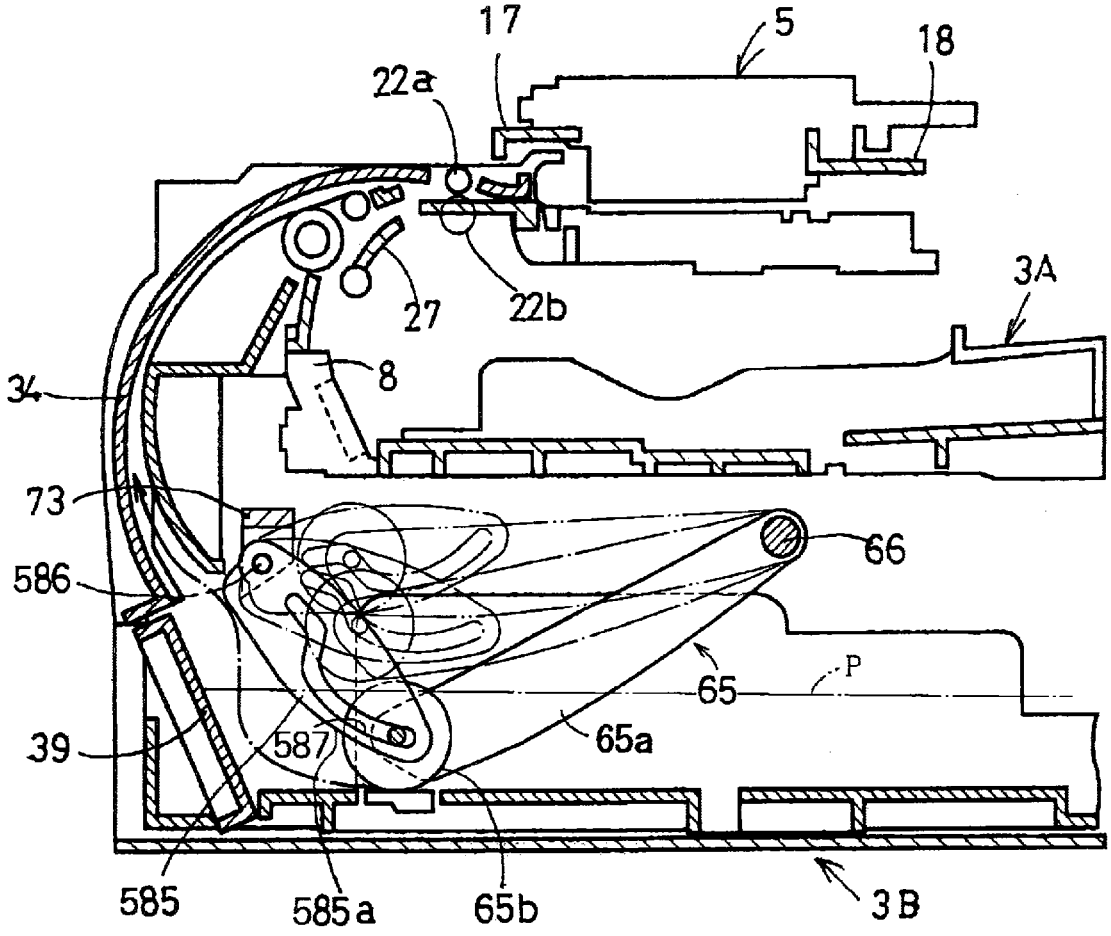
FIG. 16 is a side cross-sectional view of a restricting member and an operation of a second medium pickup device in an image recording apparatus according to a sixth embodiment of the invention.

Referring now to FIG. 16, there will be described an image recording apparatus according to a sixth embodiment. The sixth embodiment is different from the first embodiment in the structure of the restricting member and the second medium supplier. The other part of the image recording apparatus of the second embodiment is identical with that of the first embodiment and description thereof is dispensed with.

In the sixth embodiment, a link including a contact member 585 is employed as the restricting member. That is, there are disposed a plurality of the links in a second lower casing 21. An upper end of the contact member 585 is attached to a reinforcing beam 73 with a pin 586, such that the contact member 585 is held vertically pivotably around the pin 586. The contact member 585 has a guide slot 587 in which a support shaft of a medium pickup roller 65*b* disposed at a lower end of a medium pickup arm of a second medium pickup device 65 is slidably fitted. A lower side 585*a* of the contact member 585 is curved to be convex downward. The medium pickup arm is held biased downward as in the first embodiment.

According to this arrangement, when a lower medium supply cassette 3B is inserted into the second lower casing 21, the medium pickup arm 65*a* is pushed upward by the second lower casing 21, and the medium pickup roller 65*b* is accordingly displaced upward. Thus, the contact member 585 is in turn displaced upward in coupled motion. As soon as an upper end of the lower medium supply cassette 3B has passed under the contact member 585, the medium pickup arm 65*a* lowers with the medium pickup roller 65*b* and the contact member 585 down to a vertical position as indicated by one-dot chain line in FIG. 16, and latched there. This vertical position is set such that a lower end of the medium pickup roller 65*b* is slightly spaced from a top surface of a stack of recording media P in a maximum amount that the lower medium supply cassette 3B can accommodate, when the stack is accommodated in the cassette 3B as set in position in the apparatus, that is, none of the components of the second medium pickup device 65 and the contact member 585 contacts the top surface of the stack of recording media P in the maximum amount. By thus lowering the contact member 585 as soon as the cassette 3B has passed under the medium pickup roller 65*b*, movement of an end portion of at least a part of the stack on the side of a leading edge thereof, by inertia, upon insertion of the cassette 3B is restricted by contact between the at least a part of the stack and the lower side 585*a* of the contact member 585 having the downward convex configuration, in a similar way as in each of the above-described embodiments. In FIG. 16, two-dot chain line indicates positions of the medium pickup arm 65*a*, the medium pickup roller 65*b*, and the contact member 585, as pushed upward by the passing cassette 3B upon insertion thereof.

The medium pickup arm 65*a* thus lowered to its medium position indicated by one-dot chain line in FIG. 16 is held there until feeding of a recording medium P is requested. When initiation of feeding of recording media P is requested, the medium pickup arm 65*a* is lowered to a vertical position such that the medium pickup roller 65*b* contacts the top surface of the stack in order to feed the topmost one of the recording media P into a feed path. As the recording media P are consumed, the height of the stack of the recording media P gradually decreases, which accordingly lowers the level or vertical position of the pickup roller 65*b* and the contact member 585, since the medium pickup arm 65*a* is biased downward. During the recording media P are sequentially fed in, the contact member 585 basically does not contact the recording media P in order not to pull each recording medium P in a direction opposite to a direction in which the cassette 3B is inserted, but when a recording medium P deflects or buckles as being fed into the feed path, the lower side 585*a* of the contact member 585 contacts the deflecting or buckling recording medium P, thereby restricting the deflection or buckling, as in each of the above-described embodiments.

The medium pickup arm 65*a*, the medium pickup roller 65*b*, and the contact member 585 are located at respective positions indicated by solid line in FIG. 16 when the medium pickup roller 65*b* is in contact with a bottom plate of the medium supply cassette 3B, that is, when the medium pickup roller 65*b* is located at a lowermost position thereof. When the vertical position of the medium pickup roller 65*b* is relatively low near the lowermost position, in other words, when only a small amount of the recording media P, for instance one third of a stack of recording media P in the maximum amount, is left in the medium supply cassette 3B, each recording medium P may tend to deflect or buckle when fed into the feed path, but a deflecting or buckling recording medium P contacts the lower side 585*a* of the downward convex contact member 585 and further deflection or buckling is inhibited.

That is, the lower side 585*a* of the contact member 585 is located at a level not to contact the top surface of the stacked recording media P in a maximum amount that the lower medium supply cassette 3B can accommodate, but the downward convex lower side 585*a* of the contact member 585 narrows the feed path along the slant separator plate 39, similarly to each of the above-described embodiments, and thus deflection or buckling of an intermediate portion of the recording medium P as fed along the slant separator plate 39 can be restricted.

In each of the above-described embodiments, the member that contacts a surface of the recording medium P as being fed, namely, the film member 75, 383, the plummet or roller 382, 484, or the contact member 585, may be formed of an antistatic material in order to prevent static electrical charge that may be otherwise occur due to sliding contact between that member and the recording medium P. According to this arrangement, it is reliably prevented that a plurality of the recording media P are fed at a time. It is preferable that the film member 75, 383, the coil spring 381, 481, and the reinforcing beam 73 are formed If good conductor with respect to electricity, in order to discharge accidentally occurring static electrical charge.

Although there have been described several embodiments by way of example, the invention is not limited to the details described above or shown in the accompanying drawings, but may be otherwise embodied with various modifications and improvements that may occur to those skilled in the art, without departing from the scope and sprit of the invention.

For instance, the invention is applicable to an image recording apparatus having three medium supply cassettes that are set in a housing of the apparatus at respective position vertically arranged, or an image recording apparatus having a single medium supply cassette.

What is claimed is:

1. An image recording apparatus comprising:

a housing;

a medium supply cassette open upward which accommodates a stack of recording media each in the form of a sheet, and is inserted into and removed from the housing substantially horizontally in a cassette movement direction, the medium supply cassette including:

a substantially horizontal bottom plate; and a slant separator plate extending obliquely upward from an edge of the bottom plate;

a medium pickup device which includes a medium pickup roller which gives a feeding force in a first direction to a topmost one of the stack of the recording media, and cooperates with the slant separator plate to separate the topmost recording medium from the rest of the recording media to feed in the separated recording medium;

a U-shaped guide which changes a feeding direction of the recording medium as fed in by the medium pickup device, from the first direction to a second direction opposite to the first direction;

an image recording portion which records an image on the recording medium as has been passed through the U-shaped guide; and a restricting member which defines a part of a feed path along which the recording medium is fed, which part extends between the medium pickup roller and the U-shaped guide, wherein the restricting member is configured to contact at least a part of the stack of recording media which ascends upward along the slant separator plate by continuing to move, by inertia, in a cassette insertion direction in which the medium supply cassette is inserted, in order to restrict the continuing movement of the at least a part of the stack.

2. The image recording apparatus according to claim 1, wherein the restricting member is an elastic member at least a lower portion of which is located in a path of movement of the slant separator plate of the medium supply cassette when the medium supply cassette is inserted into the housing such that each time the medium supply cassette is inserted into the housing, the restricting member is pushed away by the slant separator plate and restores to an original position after passage of the slant separator plate.

3. The image recording apparatus according to claim 1, wherein the restricting member and the medium pickup roller are arranged at different positions in a lateral direction substantially perpendicular to the cassette movement direction, in plan view.

4. The image recording apparatus according to claim 3, wherein the restricting member is disposed on each of opposite sides of the medium pickup roller in the lateral direction, at least one on each side.

5. The image recording apparatus according to claim 1, wherein the restricting member has an antistatic property.

6. The image recording apparatus according to claim 1, wherein the restricting member includes an elastic film curved in a U-like shape including a curved portion which is convex downward and contacts the at least a part of the stack of recording media.

7. The image recording apparatus according to claim 6, wherein an inner surface of each of two upper end portions of the film that are opposed to each other is fixed to a stationary holding member with an adhesive, and the image recording apparatus further comprises a deformation restrictor which restricts deformation of two portions which are adjacent to the respective two upper end portions of the film and deform in the cassette movement direction when the medium supply cassette is inserted or removed.

8. The image recording apparatus according to claim 7, wherein the deformation restrictor includes a deformation restricting sheet which has two through-holes through which the two upper end portions of the film to be fixed to the holding member are respectively passed, and inner surfaces of the respective through-holes contact the two adjacent portions of the film, respectively, thereby restricting deformation of the adjacent portions.

9. The image recording apparatus according to claim 8, wherein the holding member is a beam supported by the housing and extending in a lateral direction substantially perpendicular to the cassette movement direction, in plan view.

10. The image recording apparatus according to claim 1, wherein the restricting member includes a contact member which contacts the at least a part of the recording media, and a spring member whose lower end is connected to the contact member and whose upper end is connected to a stationary holding member.

11. The image recording apparatus according to claim 10, wherein the contact member is a contact roller which rotates around an axis substantially perpendicular to the cassette movement direction, in plan view.

12. The image recording apparatus according to claim 1, wherein the restricting member includes a film curved in a U-like shape including a bottom portion, and an elastic member which is disposed inside the film and contacts an internal surface of at least the bottom portion of the film, the at least a part of the stack of the recording media at an external surface of the bottom portion while the elastic member giving an elastic deformation resistance to the film.

13. The image recording apparatus according to claim 1, further comprising a pickup arm pivotable around a first axis substantially perpendicular to the cassette movement direction, the pickup arm rotatably holding at a free end thereof the medium pickup roller, and wherein the restricting member includes a movable restricting member which is mechanically coupled, and moved, with the pickup arm.

14. The image recording apparatus according to claim 13, wherein the movable restricting member is a pivotable restricting member disposed to be pivotable around a second axis which is parallel to the first axis and extends at a position remote from the first axis, the pivotable restricting member being engaged with the pickup arm at a position remote from the second axis such that the pivotable restricting member is pivoted in accordance with pivoting of the pickup arm.

15. The image recording apparatus according to claim 1, further comprising a register roller which is disposed on the downstream side of the U-shaped guide with respect to the feeding direction in which the recording medium is fed, in order to engage a leading edge of the recording medium to correct skew of the recording medium, and wherein the restricting member includes a buckling limit determiner which allows, on the upstream side of the U-shaped guide, buckling of the recording medium whose movement is being inhibited by the register roller, while placing a limit to the buckling.

16. The image recording apparatus according to claim 15, wherein the restricting member includes a feed path defining portion, which is opposed to the slant separator plate at least while the medium pickup roller contacts the bottom plate, in order to cooperate with the slant separator plate to define a feed path along which the recording medium is fed, the feed path defining portion serving as the buckling limit determiner.

17. The image recording apparatus according to claim 1, wherein the restricting member is disposed at a position not to contact the topmost one of the stack of the recording media when the recording media are stacked in a maximum amount in terms of a capacity of the medium supply cassette.

18. An image recording apparatus comprising:

a housing;

a supply cassette having an upper opening which is configured to accommodate a stack of recording sheets, and is inserted into and removed from the housing substantially horizontally in a cassette movement direction, the supply cassette comprises:

a substantially horizontal bottom plate; and a slant separator plate extending obliquely upward from an edge of the bottom plate;

a pickup device having a pickup roller which is configured to apply a feeding force in a first direction to an uppermost sheet of a stack of recording sheets disposed in a supply cassette, the pickup device is configured to cooperate with the slant separator plate to separate an uppermost sheet from a stack of the recording sheets for feeding in a first feeding direction along a sheet feed path;

a U-shaped guide which changes the feeding direction of the recording sheet from the first feeding direction to a second direction opposite to the first direction;

an image recording portion which records an image on the recording medium as has been passed through the U-shaped guide; and a restricting member defining a part of the feed path between the pickup roller and the U-shaped guide, the restricting member is configured to contact at least a part of the stack of recording sheets ascending upward along the slant separator plate, wherein the restricting member is configured to move in a cassette insertion direction when the supply cassette is inserted to restrict the continuing movement of the at least a part of a recording sheet stack disposed in a supply cassette in the cassette insertion direction.

* * * * *